US010178485B2

(12) United States Patent
Lee et al.

(10) Patent No.: US 10,178,485 B2
(45) Date of Patent: Jan. 8, 2019

(54) METHOD FOR DETECTING WRONG POSITIONING OF EARPHONE, AND ELECTRONIC DEVICE AND STORAGE MEDIUM THEREFOR

(71) Applicant: Samsung Electronics Co., Ltd., Gyeonggi-do (KR)

(72) Inventors: Gun-Woo Lee, Gyeonggi-do (KR); Jung-Yeol An, Seoul (KR); Jong-Mo Kum, Seoul (KR); Gang-Youl Kim, Gyeonggi-do (KR); Byeong-Jun Kim, Gyeonggi-do (KR); Jae-Hyun Kim, Gyeonggi-do (KR); Nam-Il Lee, Gyeonggi-do (KR); Jun-Soo Lee, Gyeonggi-do (KR); Chul-Min Choi, Seoul (KR)

(73) Assignee: Samsung Electronic Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/808,010

(22) Filed: Nov. 9, 2017

(65) Prior Publication Data

US 2018/0152795 A1 May 31, 2018

(30) Foreign Application Priority Data

Nov. 30, 2016 (KR) ..... 10-2016-0162338

(51) Int. Cl.

*H04R 29/00* (2006.01)
*H04R 1/10* (2006.01)
*G10K 11/178* (2006.01)

(52) U.S. Cl.

CPC ..... *H04R 29/001* (2013.01); *G10K 11/178* (2013.01); *G10K 11/17833* (2018.01);
(Continued)

(58) Field of Classification Search

CPC .. H04R 29/001; H04R 1/1041; H04R 1/1016; G10K 11/178; G10K 11/1786; G10K 2210/1081

See application file for complete search history.

(56) References Cited

U.S. PATENT DOCUMENTS 8,416,961 B2 4/2013 Lee et al.
8,750,527 B2 6/2014 Tiscareno et al.
(Continued)

FOREIGN PATENT DOCUMENTS

JP 2013-121105 A 6/2013
KR 10-1353686 B1 1/2014
(Continued)

OTHER PUBLICATIONS

International Search Report dated Jan. 31, 2018.

*Primary Examiner* — Sonia Gay
(74) *Attorney, Agent, or Firm* — Cha & Reiter, LLC.

(57) ABSTRACT

A method for detecting wrong positioning of an earphone, and an electronic device and storage medium therefor are provided. The electronic device includes a speaker positioned on surface of a housing; and at least one processor configured to determine a positioning state of an earphone detachably connectable to the electronic device based on a difference between a first audio signal received through at least one microphone positioned in a first body of the earphone and a second audio signal received through at least one microphone positioned in a second body of the earphone.

18 Claims, 27 Drawing Sheets

(52) U.S. Cl.
CPC ..... *G10K 11/17873* (2018.01); *H04R 1/1016* (2013.01); *H04R 1/1041* (2013.01); *G10K 2210/1081* (2013.01)

(56) References Cited

U.S. PATENT DOCUMENTS

| | | | | |
|---|---|---|---|---|
| 9,049,508 | B2 | 6/2015 | Puskarich | |
| 2010/0246846 | A1* | 9/2010 | Burge | H04R 1/1041 381/74 |
| 2011/0038484 | A1* | 2/2011 | Macours | H04R 5/04 381/17 |
| 2012/0114154 | A1 | 5/2012 | Abrahamsson | |
| 2012/0128166 | A1* | 5/2012 | Kim | H04R 3/005 381/58 |
| 2013/0279724 | A1 | 10/2013 | Stafford et al. | |
| 2014/0062887 | A1* | 3/2014 | Lee | G06F 3/02 345/168 |
| 2014/0172421 | A1* | 6/2014 | Liu | H04R 1/1083 704/227 |
| 2014/0307884 | A1 | 10/2014 | Asada et al. | |
| 2015/0358715 | A1* | 12/2015 | Macours | H04R 1/1041 381/74 |
| 2016/0050509 | A1* | 2/2016 | Madhu | H04R 1/1041 381/309 |

FOREIGN PATENT DOCUMENTS

| | | | |
|---|---|---|---|
| KR | 101475265 | B1 | 12/2014 |
| KR | 10-1518352 | B1 | 5/2015 |
| KR | 101609777 | B1 | 4/2016 |

* cited by examiner

METHOD FOR DETECTING WRONG POSITIONING OF EARPHONE, AND ELECTRONIC DEVICE AND STORAGE MEDIUM THEREFOR

CLAIM OF PRIORITY

This application claims the benefit under 35 U.S.C. § 119(a) of a Korean patent application filed in the Korean Intellectual Property Office on Nov. 30, 2016 and assigned Serial No. 10-2016-0162338, the entire disclosure of which is incorporated herein by reference.

TECHNICAL FIELD

The present disclosure relates to a method for detecting wrong positioning of an earphone inserted into an electronic device, and an electronic device therefor.

BACKGROUND

Owing to the recent improvement in the performance of electronic devices (for example, smartphones), users may receive multimedia service such as a video and music at any time and any place. During the multimedia service through an electronic device, a user may use an earphone to avoid disturbing others in the user's vicinity, privacy, or to listen to sounds more clearly. For example, an earphone or a headset is a device which is connected to an electronic device and transfers an audio signal from the electronic device to a user's ears, including speakers and a microphone. The speakers inside the earphone may output audio signals from the electronic device, and the microphone at a portion of the earphone may transmit a voice signal to the electronic device during a voice call.

However, since the earphone or the headset is configured to be inserted into the left and right ears of the user, the left speaker of the earphone should be inserted into the left ear of the user, and the right speaker of the earphone should be inserted into the right ear of the user. If the left and right speakers are inserted into the opposite ears of the user, the user may not accurately hear sounds from the electronic device. For example, when the user talks during a voice call in a noisy environment, it is preferred to separate background noise from a voice signal of the user. However, if either of the left and right speakers of the ear phone has slipped off from the user's ear or the left and right speakers are in the opposite ears, part of the voice of the user may be regarded as noise, or part of background noise such as music or conversation may not be regarded as noise.

Accordingly, in a wrong positioning state of the earphone such as slip-off of either of the left and right speakers or insertion of the left and right speakers into the opposite ears of the user, there is a need for notifying the user of the wrong positioning state, outputting audio signals corresponding to the left and right ears of the user according to the positioning state of the earphone without making the user change the positioning state, correcting a recording signal, or effectively cancelling only background noise from a voice signal.

The above information is presented as background information only to assist with an understanding of the present disclosure. No determination has been made, and no assertion is made, as to whether any of the above might be applicable as prior art with regard to the present disclosure.

SUMMARY

An aspect of the present disclosure may address at least the above-mentioned problems and/or disadvantages and may provide at least the advantages described below. Accordingly, an aspect of the present disclosure is may provide a method for detecting wrong positioning of an earphone inserted into an electronic device, and an electronic device therefor.

In accordance with an aspect of the present disclosure, there is provided an electronic device. The electronic device includes a speaker positioned on surface of a housing and at least one processor configured to determine a positioning state of an earphone detachably connectable to the electronic device based on a difference between a first audio signal received through at least one microphone positioned in a first body of the earphone and a second audio signal received through at least one microphone positioned in a second body of the earphone.

In accordance with another aspect of the present disclosure, there is provided a method for detecting wrong positioning of an earphone by an electronic device. The method comprises receiving a first audio signal through microphone first microphone positioned in a first body of an earphone operatively connected to the electronic device, and a second audio signal through a second microphone positioned in a second body of the earphone; and determining a positioning state of the earphone based on a difference between the first audio signal and the second audio signal.

In accordance with another aspect of the present disclosure, a non-transitory computer-readable storage medium stores instructions configured to, when executed by at least one processor, control the at least one processor to perform at least one operation, the at least one operation comprising receiving a first audio signal through a first microphone positioned in a first body of an earphone operatively connected to an electronic device, and a second audio signal through a second microphone positioned in a second body of the earphone; and determining a positioning state of the earphone based on a difference between the first audio signal and the second audio signal.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

The above and other aspects, features and advantages of certain exemplary embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
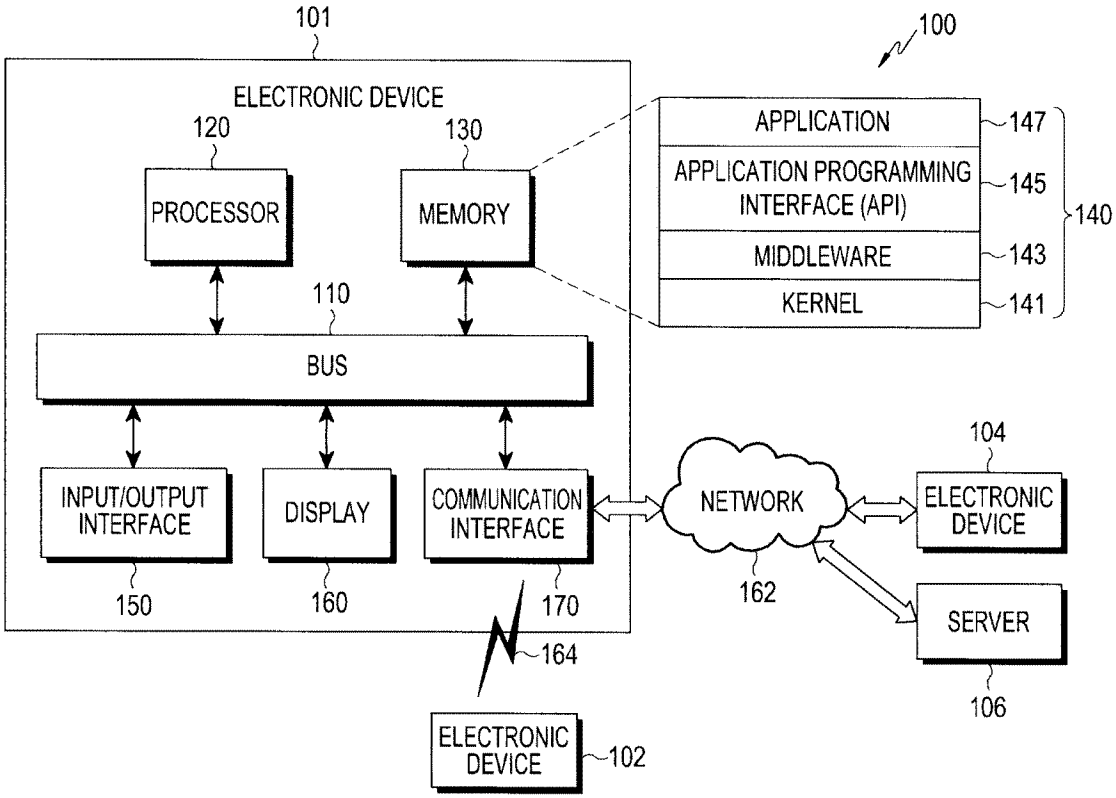
FIG. 1 is a block diagram of a network environment including electronic devices according to various embodiments.

Various embodiments of the present disclosure are described with reference to the accompanying drawings. However, the embodiments and terms as used herein are not intended to limit technologies described in the present disclosure to the particular embodiments, and it is to be understood that the present disclosure covers various modifications, equivalents, and/or alternatives to the embodiments. In relation to a description of the drawings, like reference numerals denote the same components. Unless otherwise specified in the context, singular expressions may include plural referents. In the present disclosure, the term 'A or B', or 'at least one of A or/and B' may cover all possible combinations of enumerated items. The term as used in the present disclosure, 'first' or 'second' may modify the names of components irrespective of sequence or importance. These expressions are used to distinguish one component from another component, not limiting the components. When it is said that a component (for example, a first component) is '(operatively or communicatively) coupled with/to' or 'connected to' another component (for example, a second component), it should be understood that the one component is connected to the other component directly or through any other component (for example, a third component).

The term 'configured to' as used herein may be replaced with, for example, the term 'suitable for' 'having the capacity to', 'designed to', 'adapted to', 'made to', or 'capable of' in hardware or software. The term 'configured to' may mean that a device is 'capable of' with another device or part. For example, 'a processor configured to execute A, B, and C' may mean a dedicated processor (for example, an embedded processor) for performing the corresponding operations or a generic-purpose processor (for example, a central processing unit (CPU) or an application processor (AP)) for performing the operations.

According to various embodiments of the present disclosure, an electronic device may be at least one of, for example, a smart phone, a tablet personal computer (PC), a mobile phone, a video phone, an e-Book reader, a desktop PC, a laptop PC, a netbook computer, a workstation, a server, a personal digital assistant (PDA), a portable multimedia player (PMP), an MP3 player, medical equipment, a camera, or an wearable device. The wearable device may be at least one of an accessory type (for example, a watch, a ring, a bracelet, an ankle bracelet, a necklace, glasses, contact lenses, or a head-mounted device (HMD)), a fabric or clothes type (for example, electronic clothes), an attached type (for example, a skin pad or a tattoo), or an implantable circuit. According to some embodiments, an electronic device may be at least one of a television (TV), a digital versatile disk (DVD) player, an audio player, a refrigerator, an air conditioner, a vacuum cleaner, an oven, a microwave oven, a washer, an air purifier, a set-top box, a home automation control panel, a security control panel, a media box (for example, Samsung HomeSync™, Apple TV™, Google TV™, or the like), a game console (for example, Xbox™, PlayStation™, or the like), an electronic dictionary, an electronic key, a camcorder, or an electronic picture frame.

According to other embodiments, an electronic device may be at least one of a medical device (for example, a portable medical meter such as a blood glucose meter, a heart rate meter, a blood pressure meter, or a body temperature meter, a magnetic resonance angiography (MRA) device, a magnetic resonance imaging (MRI) device, a computed tomography (CT) device, an imaging device, an ultrasonic device, or the like), a navigation device, a global navigation satellite system (GNSS), an event data recorder (EDR), a flight data recorder (FDR), an automotive infotainment device, a naval electronic device (for example, a naval navigation device, a gyrocompass, or the like), an avionic electronic device, a security device, an in-vehicle head unit, an industrial or consumer robot, a drone, an automatic teller machine (ATM) in a financial facility, a point of sales (POS) device in a shop, or an Internet of things (IoT) device (for example, a lighting bulb, various sensors, a sprinkler, a fire alarm, a thermostat, a street lamp, a toaster, sports goods, a hot water tank, a heater, or a boiler). According to some embodiments, an electronic device may be at least one of furniture, part of a building/structure or a vehicle, an electronic board, an electronic signature receiving device, a projector, and various measuring devices (for example, water, electricity, gas or electro-magnetic wave measuring devices). According to various embodiments, an electronic device may be flexible or a combination of two or more of the foregoing devices. According to an embodiment of the present disclosure, an electronic device is not limited to the foregoing devices. In the present disclosure, the term 'user' may refer to a person or device (for example, artificial intelligence electronic device) that uses an electronic device.

Electronic Device

Referring to FIG. 1, an electronic device 101 in a network environment 100 according to various embodiments is described. The electronic device 101 may include a bus 110, a processor 120, a memory 130, an input/output (I/O) interface 150, a display 160, and a communication interface 170. In some embodiments, at least one of the components may be omitted in the electronic device 101 or a component may be added to the electronic device 101. The bus 110 may include a circuit that interconnects, the foregoing components 120, 130, 150, 160, and 170 and allows communication (for example, control messages and/or data) between the foregoing components. The processor 120 may include one or more of a CPU, an AP, or a communication processor (CP). The processor 120 may, for example, execute computation or data processing related to control and/or communication of at least one other component of the electronic device 101. The processor 120 may be called a controller.

The memory 130 may include a volatile memory and/or a non-volatile memory. The memory 130 may, for example, store instructions or data related to at least one other component of the electronic device 101. According to an embodiment, the memory 130 may store software and/or programs 140. The programs 140 may include, for example, a kernel 141, middleware 143, an application programming interface (API) 145, and/or application programs (or applications) 147. At least a part of the kernel 141, the middleware 143, and the API 145 may be called an operating system (OS). The kernel 141 may control or manage system resources (for example, the bus 110, the processor 120, or the memory 130) that are used in executing operations or functions implemented in other programs (for example, the middleware 143, the API 145, or the application programs 147). Also, the kernel 141 may provide an interface for allowing the middleware 143, the API 145, or the application programs 147 to access individual components of the electronic device 101 and control or manage system resources.

The middleware 143 may serve as a medium through which the kernel 141 may communicate with, for example, the API 145 or the application programs 147 to transmit and receive data. Also, the middleware 143 may process one or more task requests received from the application programs 147 according to their priority levels. For example, the middleware 143 may assign priority levels for using system resources (the bus 110, the processor 120, or the memory 130) of the electronic device 101 to at least one of the application programs 147, and process the one or more task requests according to the priority levels. The API 145 is an interface for the applications 147 to control functions that the kernel 141 or the middleware 143 provides. For example, the API 145 may include at least one interface or function (for example, a command) for file control, window control, video processing, or text control. The I/O interface 150 may, for example, provide a command or data received from a user or an external device to the other component(s) of the electronic device 101, or output a command or data received from the other component(s) of the electronic device 101 to the user or the external device.

The display 160 may include, for example, a liquid crystal display (LCD), a light emitting diode (LED) display, an organic LED (OLED) display, a microelectromechanical systems (MEMS) display, or an electronic paper display. The display 160 may display, for example, various types of content (for example, text, an image, a video, an icon, and/or a symbol) to the user. The display 160 may include a touch screen and receive, for example, a touch input, a gesture input, a proximity input, or a hovering input through an electronic pen or a user's body part. The communication interface 170 may establish communication, for example, between the electronic device 101 and an external device (for example, a first external electronic device 102, a second external electronic device 104, or a server 106). For example, the communication interface 170 may be connected to a network 162 by wireless communication or wired communication, and communicate with the external device (for example, the second external electronic device 104 or the server 106) over the network 162.

The wireless communication may include cellular communication conforming to, for example, at least one of long term evolution (LTE), LTE-advanced (LTE-A), code division multiple access (CDMA), wideband CDMA (WCDMA), universal mobile telecommunication system (UMTS), wireless broadband (WiBro), or global system for mobile communications (GSM). According to an embodiment, the wireless communication may include, for example, at least one of wireless fidelity (WiFi), Bluetooth, Bluetooth low energy (BLE), Zigbee, near field communication (NFC), magnetic secure transmission (MST), radio frequency (RF), or body area network (BAN). According to an embodiment, the wireless communication may include GNSS. GNSS may be, for example, global positioning system (GPS), global navigation satellite system (Glonass), Beidou navigation satellite system (hereinafter, referred to as 'Beidou'), or Galileo, the European global satellite-based navigation system. In the present disclosure, the terms 'GPS' and 'GNSS' are interchangeably used with each other. The wired communication may be conducted in conformance to, for example, at least one of universal serial bus (USB), high definition multimedia interface (HDMI), recommended standard 232 (RS-232), power line communication, or plain old telephone service (POTS). The network 162 may be a telecommunication network, for example, at least one of a computer network (for example, local area network (LAN) or wide area network (WAN)), the Internet, or a telephone network.

Each of the first and second external electronic devices 102 and 104 may be of the same type as or a different type from the electronic device 101. According to various embodiments, all or a part of operations performed in the electronic device 101 may be performed in one or more other electronic devices (for example, the electronic devices 102 and 104) or the server 106. According to an embodiment, if the electronic device 101 is to perform a function or a service automatically or upon request, the electronic device 101 may request at least a part of functions related to the function or the service to another device (for example, the electronic device 102 or 104 or the server 106), instead of performing the function or the service autonomously, or additionally. The other electronic device (for example, the electronic device 102 or 104 or the server 106) may execute the requested function or an additional function and provide a result of the function execution to the electronic device 101. The electronic device 101 may provide the requested function or service based on the received result or by additionally processing the received result. For this purpose, for example, cloud computing, distributed computing, or client-server computing may be used.

According to various embodiments of the present disclosure, a body of the electronic device 101 may include a housing forming the exterior of the electronic device 101, and a hole (for example, a connection member) may be formed on the housing, for allowing a plug to be inserted therethrough. To facilitate insertion of a plug into the hole, the hole may be formed to be exposed on one side surface of the housing of the electronic device 101, and the plug may be inserted into and thus electrically connected to the hole. The hole may form a portion of the input/output interface 150.

Figure 2:
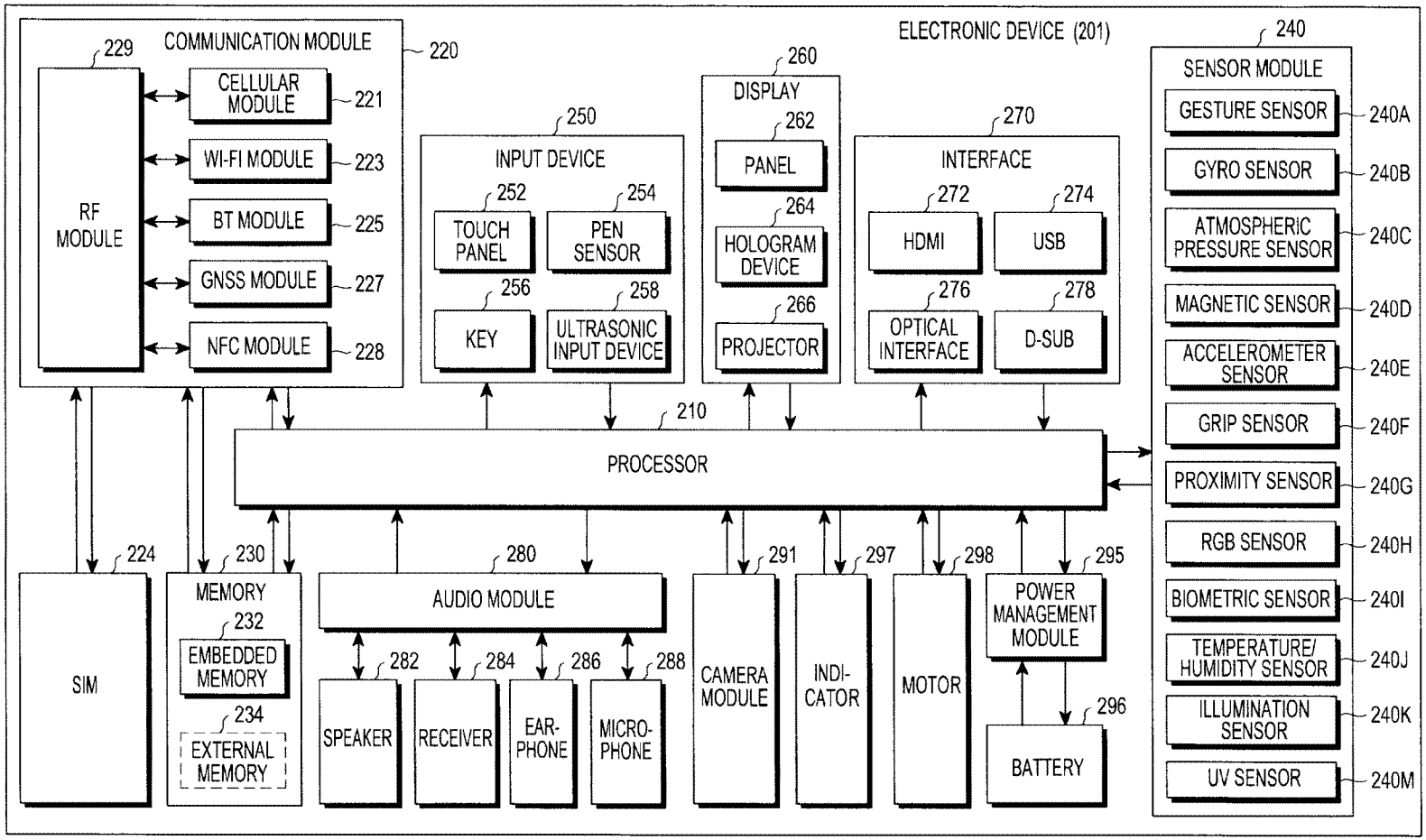
FIG. 2 is a block diagram of an electronic device according to various embodiments.

FIG. 2 is a block diagram of an electronic device 201 according to various embodiments of the present disclosure. The electronic device 201 may include, for example, the whole or part of the electronic device 101 illustrated in FIG. 1. The electronic device 201 may include at least one processor (for example, AP) 210, a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298. The processor 210 may, for example, control a plurality of hardware or software components that are connected to the processor 210 by executing an OS or an application program, and may perform processing or computation of various types of data. The processor 210 may be implemented, for example, as a system on chip (SoC). According to an embodiment, the processor 210 may further include a graphics processing unit (GPU) and/or an image signal processor. The processor 210 may include at least a part (for example, a cellular module 221) of the components illustrated in FIG. 2. The processor 210 may load a command or data received from at least one of other components (for example, a non-volatile memory), process the loaded command or data, and store result data in the non-volatile memory.

The communication module 220 (for example, the communication interface 170) may include, for example, the cellular module 221, a WiFi module 223, a Bluetooth (BT) module 225, a GNSS module 227, an NFC module 228, and an RF module 229. The cellular module 221 may provide services such as voice call, video call, text service, or the Internet service, for example, through a communication network. According to an embodiment, the cellular module 221 may identify and authenticate the electronic device 201 within a communication network, using the SIM (for example, a SIM card) 224. According to an embodiment, the cellular module 221 may perform at least a part of the functionalities of the processor 210. According to an embodiment, the cellular module 221 may include a CP. According to an embodiment, at least a part (for example, two or more) of the cellular module 221, the WiFi module 223, the BT module 225, the GNSS module 227, or the NFC module 228 may be included in a single integrated chip (IC) or IC package. The RF module 229 may transmit and receive, for example, communication signals (for example, RF signals). The RF module 229 may include, for example, a transceiver, a power amplifier module (PAM), a frequency filter, a low noise amplifier (LNA), an antenna, or the like. According to another embodiment, at least one of the cellular module 221, the WiFi module 223, the BT module 225, the GNSS module 227, or the NFC module 228 may transmit and receive RF signals via a separate RF module. The SIM 224 may include, for example, a card including the SIM and/or an embedded SIM. The SIM 224 may include a unique identifier (for example, integrated circuit card identifier (ICCID)) or subscriber information (for example, international mobile subscriber identity (IMSI)).

The memory 230 (for example, the memory 130) may include, for example, an internal memory 232 or an external memory 234. The internal memory 232 may be at least one of, for example, a volatile memory (for example, dynamic RAM (DRAM), static RAM (SRAM), or synchronous dynamic RAM (SDRAM)), and a non-volatile memory (for example, one time programmable ROM (OTPROM), programmable ROM (PROM), erasable and programmable ROM (EPROM), electrically erasable and programmable ROM (EEPROM), mask ROM, flash ROM, flash memory, a hard drive, or a solid state drive (SSD)). The external memory 234 may include a flash drive such as a compact flash (CF) drive, a secure digital (SD), a micro secure digital (micro-SD), a mini secure digital (mini-SD), an extreme digital (xD), a multi-media card (MMC), or a memory stick. The external memory 234 may be operatively or physically coupled to the electronic device 201 via various interfaces.

The sensor module 240 may, for example, measure physical quantities or detect operational states of the electronic device 201, and convert the measured or detected information into electric signals. The sensor module 240 may include at least one of, for example, a gesture sensor 240A, a gyro sensor 240B, an atmospheric pressure sensor 240C, a magnetic sensor 240D, an accelerometer sensor 240E, a grip sensor 240F, a proximity sensor 240G, a color sensor (for example, a red, green, blue (RGB) sensor) 240H, a biometric sensor 2401, a temperature/humidity sensor 240J, an illumination sensor 240K, or an ultra violet (UV) sensor 240M. Additionally or alternatively, the sensor module 240 may include, for example, an electrical-nose (E-nose) sensor, an electromyogram (EMG) sensor, an electroencephaloeram (EEG) sensor, an electrocardiogram (ECG) sensor, an infrared (IR) sensor, an iris sensor, and/or a finger print sensor. The sensor module 240 may further include a control circuit for controlling one or more sensors included therein. According to some embodiments, the electronic device 201 may further include a processor configured to control the sensor module 240, as a part of or separately from the processor 210. Thus, while the processor 210 is in a sleep state, the control circuit may control the sensor module 240.

The input device 250 may include, for example, a touch panel 252, a (digital) pen sensor 254, a key 256, or an ultrasonic input device 258. The touch panel 252 may operate in at least one of, for example, capacitive, resistive, infrared, and ultrasonic schemes. The touch panel 252 may further include a control circuit. The touch panel 252 may further include a tactile layer to thereby provide haptic feedback to the user. The (digital) pen sensor 254 may include, for example, a detection sheet which is a part of the touch panel or separately configured from the touch panel. The key 256 may include, for example, a physical button, an optical key, or a keypad. The ultrasonic input device 258 may sense ultrasonic signals generated by an input tool using a microphone (for example, a microphone 288), and identify data corresponding to the sensed ultrasonic signals.

The display 260 (for example, the display 160) may include a panel 262, a hologram device 264, a projector 266, and/or a control circuit for controlling them. The panel 262 may be configured to be, for example, flexible, transparent, or wearable. The panel 262 and the touch panel 252 may be implemented as one or more modules. According to an embodiment, the panel 262 may include a pressure sensor (or a force sensor) for measuring the strength of the pressure of a user touch. The pressure sensor may be integrated with the touch panel 252, or configured as one or more sensors separately from the touch panel 252. The hologram device 264 may utilize the interference of light waves to provide a three-dimensional image in empty space. The projector 266 may display an image by projecting light on a screen. The screen may be positioned, for example, inside or outside the electronic device 201. The interface 270 may include, for example, an HDMI 272, a USB 274, an optical interface 276, or a D-subminiature (D-sub) 278. The interface 270 may be included, for example, in the communication interface 170 illustrated in FIG. 1. Additionally or alternatively, the interface 270 may include, for example, a mobile high-definition link (MHL) interface, an SD/multimedia card (MMC) interface, or an infrared data association (IrDA) interface.

The audio module 280 may, for example, convert a sound to an electrical signal, and vice versa. At least a part of the components of the audio module 280 may be included, for example, in the I/O interface 150 illustrated in FIG. 1. The audio module 280 may process sound information input into, or output from, for example, a speaker 282, a receiver 284, an earphone 286, or the microphone 288. The camera module 291 may capture, for example, still images and a video. According to an embodiment, the camera module 291 may include one or more image sensors (for example, a front sensor or a rear sensor), a lens, an image signal processor (ISP), or a flash (for example, an LED or a xenon lamp). The power management module 295 may manage power of, for example, the electronic device 201. According to an embodiment, the power management module 295 may include a power management integrated circuit (PMIC), a charger IC, or a battery or fuel gauge. The PMIC may adopt wired and/or wireless charging. The wireless charging may be performed, for example, in a magnetic resonance scheme, a magnetic induction scheme, or an electromagnetic wave scheme, and may further include an additional circuit for wireless charging, for example, a coil loop, a resonance circuit, or a rectifier. The battery gauge may measure, for example, a charge level, a voltage while charging, current, or temperature of the battery 296. The battery 296 may include, for example, a rechargeable battery and/or a solar battery.

The indicator 297 may indicate specific states of the electronic device 201 or a part of the electronic device 201 (for example, the processor 210), for example, boot status, message status, or charge status. The electronic device 201 may include, for example, a mobile TV support device (for example, a GPU) for processing media data compliant with, for example, digital multimedia broadcasting (DMB), digital video broadcasting (DVB), or MediaFLO™. Each of the above-described components of the electronic device may include one or more parts and the name of the component may vary with the type of the electronic device. According to various embodiments, some component may be omitted from or added to the electronic device (for example, the electronic device 201). Or one entity may be configured by combining a part of the components of the electronic device, to thereby perform the same functions of the components prior to the combining.

Figure 3:
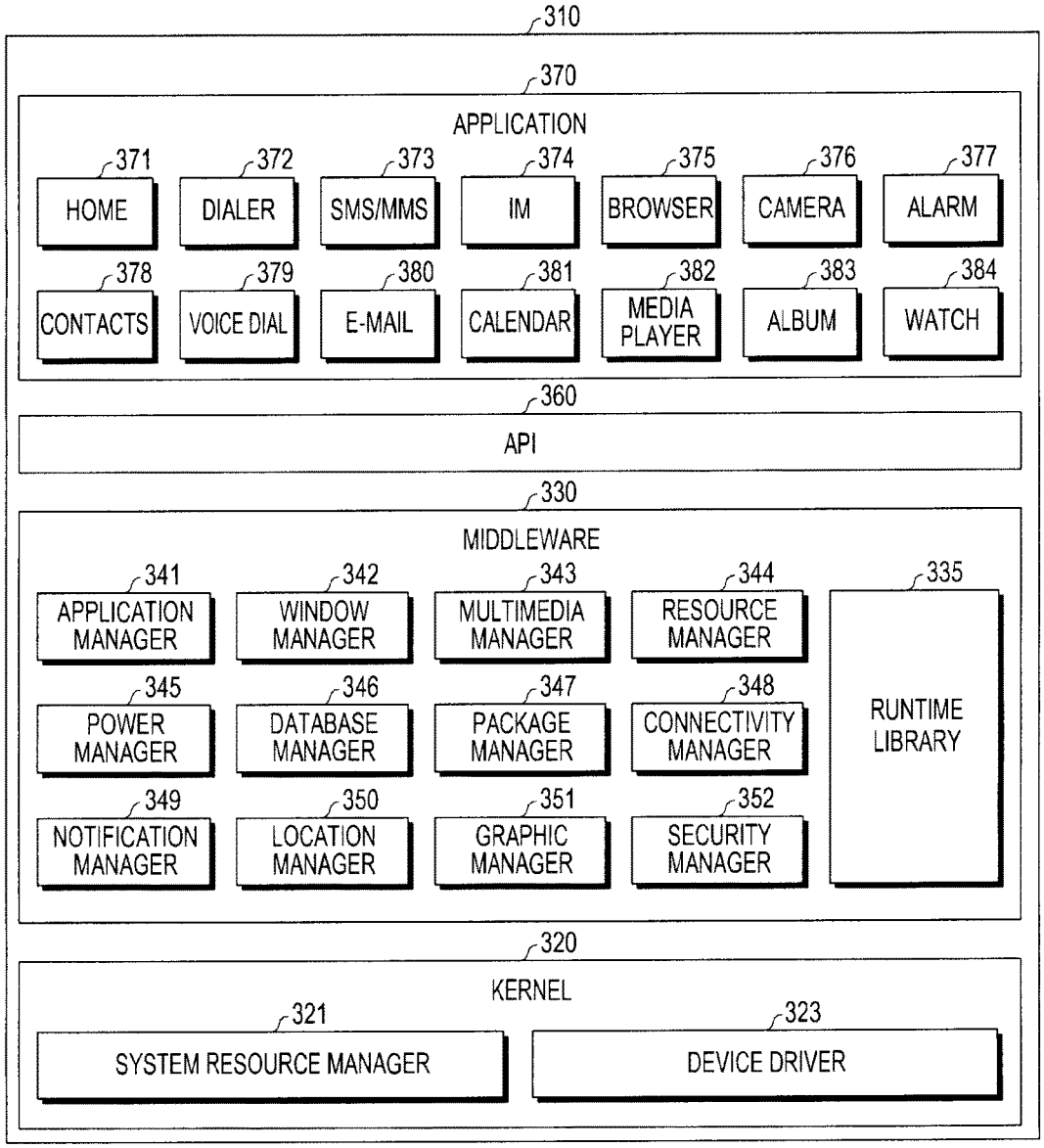
FIG. 3 is a block diagram of a programming module according to various embodiments.

FIG. 3 is a block diagram of a programming module according to various embodiments. According to an embodiment, a programming module 310 (for example, a program 140) may include an OS that controls resources related to an electronic device (for example, the electronic device 101) and/or various applications executed on the OS (for example, the application programs 147). For example, the OS may be Android™, iOS™, Windows™, Symbian™, Tizen™, or Bada™. Referring to FIG. 3, the programming module 310 may include a kernel 320 (for example, the kernel 141), middleware 330 (for example, the middleware 143), an application programming interface (API) 360 (for example, the API 145), and/or applications 370 (for example, the application programs 147). At least a part of the programming module 310 may be preloaded on the electronic device or downloaded from an external electronic device (for example, the electronic device 102 or 104, or the server 106).

The kernel 320 may include, for example, a system resource manager 321 and/or a device driver 323. The system resource manager 321 may control, allocate, or deallocate system resources. According to an embodiment, the system resource manager 321 may include a process manager, a memory manager, or a file system manager. The device driver 323 may include, for example, a display driver, a camera driver, a Bluetooth driver, a shared memory driver, a USB driver, a keypad driver, a WiFi driver, an audio driver, or an inter-process communication (IPC) driver. The middleware 330 may, for example, provide a function required commonly for the applications 370 or provide various functionalities to the applications 370 through the API 360 so that the applications 370 may use limited system resources available within the electronic device. According to an embodiment, the middleware 330 may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, or a security manager 352.

The runtime library 335 may include, for example, a library module that a complier uses to add a new function in a programming language during execution of an application 370. The runtime library 335 may perform input/output management, memory management, or arithmetic function processing. The application manager 341 may manage, for example, the life cycle of the applications 370. The window manager 342 may manage GUI resources used for a screen. The multimedia manager 343 may determine formats required to play back media files and may encode or decode a media file using a CODEC suitable for the format of the media file. The resource manager 344 may manage a source code or a memory space. The power manager 345 may, for example, manage a battery or a power source and provide power information required for an operation of the electronic device. According to an embodiment, the power manager 345 may interact with a basic input/output system (BIOS). The database manager 346 may, for example, generate, search, or modify a database to be used for the applications 370. The package manager 347 may manage installation or update of an application distributed as a package file.

The connectivity manager 348 may manage, for example, wireless connectivity. The notification manager 349 may provide a user with an event such as message arrival, a schedule, a proximity notification, or the like. The location manager 350 may, for example, mange position information about the electronic device. The graphic manager 351 may, for example, manage graphical effects to be provided to the user or related user interfaces. The security manager 352 may, for example, provide system security or user authentication. In an embodiment, the middleware 330 may include a telephony manager to manage a voice or video call function of the electronic device, or a middleware module for combining functions of the above-described components. According to an embodiment, the middleware 330 may provide a customized module for each OS type. The middleware 330 may dynamically delete a part of the existing components or add a new component. The API 360 is, for example, a set of API programming functions, which may be configured differently according to an OS. For example, in the case of Android or iOS, one API set may be provided per platform, whereas in the case of Tizen, two or more API sets may be provided per platform.

The applications 370 may include home 371, dialer 372, short message service/multimedia messaging service (SMS/MMS) 373, instant message (IM) 374, browser 375, camera 376, alarm 377, contacts 378, voice dial 379, email 380, calendar 381, media player 382, album 383, watch 384, health care (for example, measurement of an exercise amount or a glucose level), or an application for providing environment information (for example, information about atmospheric pressure, humidity, or temperature). According to an embodiment, the applications 370 may include an information exchange application capable of supporting information exchange between the electronic device and an external electronic device. The information exchange application may include, for example, a notification relay application for transmitting specific information to the external electronic device or a device management application for managing the external electronic device. For example, the notification relay application may transmit notification information generated from another application to the external electronic device, or receive notification information from the external electronic device and transmit the received notification information to a user. The device management application may, for example, install, delete, or update functions of the external electronic device communicating with the electronic device (for example, turn-on/turn-off of the external electronic device (or a part of its components) or control of the brightness (or resolution) of the display), or an application executed in the external electronic device. According to an embodiment, the applications 370 may include (an application (for example, a health care application of a mobile medical equipment) designated according to a property of the external electronic device. According to an embodiment, the applications 370 may include an application received from an external electronic device. At least a part of the programming module 310 may be realized (for example, implemented) in software, firmware, hardware (for example, the processor 210), or a combination of at least two of them, and may include a module, a program, a routine, a set of instructions, or a process to execute one or more functions.

Housing, Speakers, and Microphone

Figure 4A:
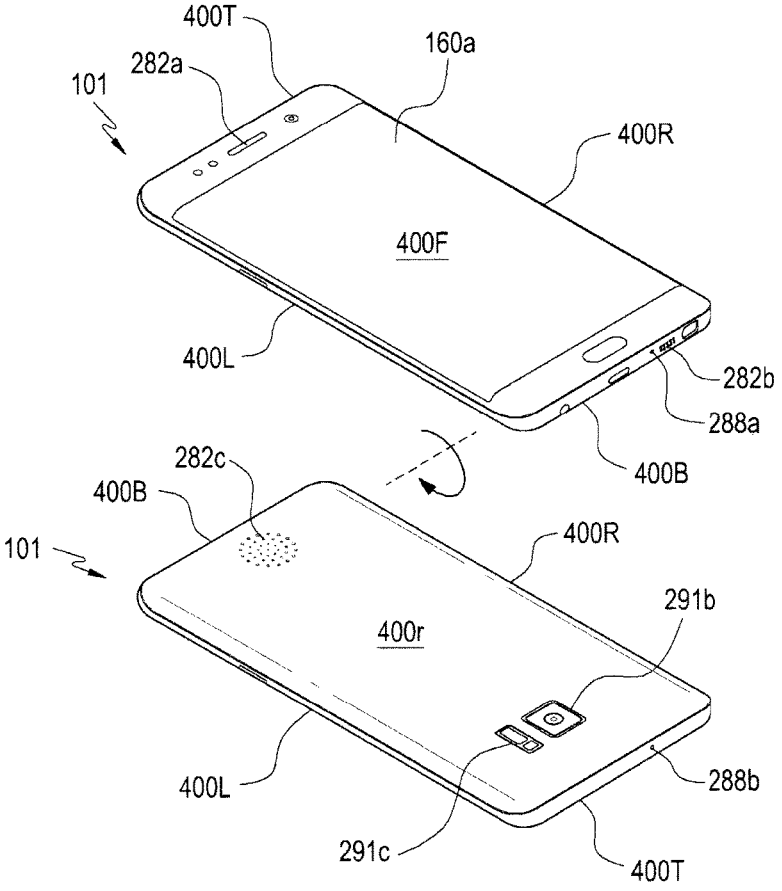
FIG. 4A is a perspective view of an electronic device according to various embodiments.

FIG. 4A is a perspective view of an electronic device according to various embodiments. The electronic device comprises a housing 400. The housing 400 can be in the form of generally thin rectangular planar form, having a front surface 400F, a rear surface 400*r*. The front 400T and rear 400*r* surfaces are generally separated by a thin side surfaces, top surface 400T, right surface 400R, bottom surface 400B, and left surface 400L. The front surface 400F can be considered the surface that the display is 160/260 is disposed on. The rear surface 400*r* is opposite the front surface 400F. The top surface 400T can be considered the surface that is along the nearest the top of a displayed picture on the display 160/260 in the portrait display mode. The left and right surfaces 400L, 400R are on the left and right hand side when the electronic device is oriented such that the front surface 400F is facing the user and the top surface 400T is at the top. The bottom surface 400B is opposite the top surface 400B.

Referring to FIG. 4A, a display 160*a* may be disposed in the form of a touch screen on the front surface 400F of the electronic device 101. The display 160*a* may be formed to be so large as to occupy the entirety of the front surface 400F of the electronic device 101. A speaker 282*a* may be disposed at a first end of the front surface 400F of the housing 400 of the electronic device 101. According to an embodiment, the speaker 282*a* may be disposed at the first end (for example, towards the top surface 400T) of the front surface 400F of the electronic device 101 so that when a user talks, holding the electronic device 101 on an ear of the user, the user may hear the voice of the other party.

As illustrated in FIG. 4A, a speaker 282*b* may be positioned on the bottom surface 400B or at a second end of the front surface 400F (near the intersection of the front surface 400F and the bottom surface 400B) of the housing of the electronic device 101.

Herein, the speaker 282*a* may act as a receiver that converts a voice signal to an audible sound and outputs the audible sound during a voice call, and all sound sources except for voice during a call, for example, a sound source during music or video play may be output through the speaker 282*b*. Additionally, another speaker 282*c* may be positioned on the rear surface 400*r* of the housing near the intersection of the rear surface 400*r* and the bottom surface 400B in the electronic device 101. Speaker 282*c* can be positioned so that a sound source may be output in a direction opposite to a direction in which the speaker 282*a* faces on the front surface 400F. For example, as illustrated in FIG. 4A, a rear camera 291*b* and a flash 291*c* may be disposed on the rear surface 400*r* of the electronic device 101 near the intersection of the rear surface 400*r* and the top surface 400T, and a speaker may be disposed on the rear surface 400*r* near the intersection of the rear surface 400*r* and the bottom surface 400B of the electronic device 101. The number and positions of speakers may not be limited to the above-described value and positions.

In certain embodiments, the specific positions of speakers, such as speaker 282*b* at the bottom surface 400B near the right surface 400R, and the orientation of the electronic device 101 can be used to determine whether the earphone is properly inserted in both ears, and not inserted in opposite ears.

Further, at least one microphone 288*a* may be disposed on the bottom surface 400B (or on the front surface 400F near the bottom surface 400B) of the housing in the electronic device 101. According to an embodiment, the microphone 288*a* may face outward from the housing, and may be positioned in the edge area of the bottom surface 400B so as to receive the user's voice. As far as the microphone 288*a* is capable of receiving a user's voice or an external sound, any other position is available to the microphone 288*a*. While the microphone 288*a* is shown in FIG. 4A as positioned on the bottom surface 400B, near to the speaker 282*b*, by way of example, an additional microphone 288*b* may be disposed on the top surface 400T at a position opposite to the microphone 288*a*.

Earphone

Figure 4B:
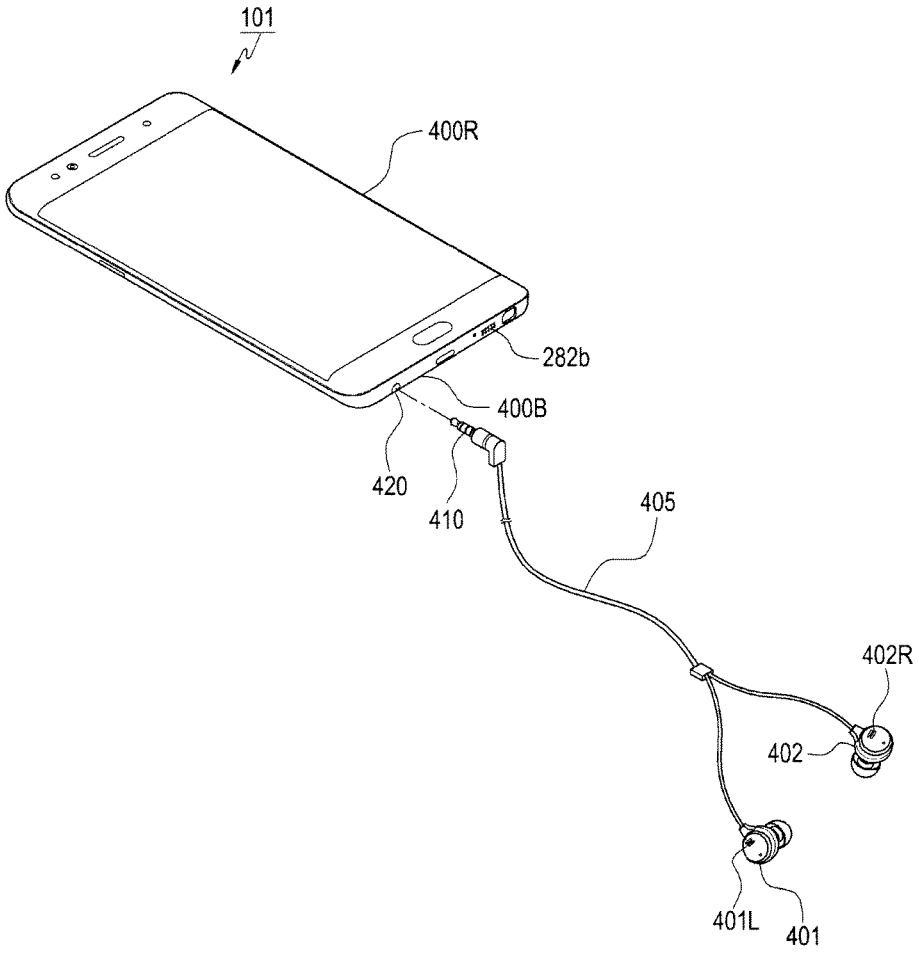
FIG. 4B is a schematic view of an electronic device and an earphone connected to the electronic device according to various embodiments.

FIG. 4B is a schematic view illustrating an electronic device and an earphone connected to the electronic device according to various embodiments.

Referring to FIG. 4B, the electronic device 101 may be configured to include a connection member 420 for connection to an earphone 405. The connection member 420 may be referred to as an interface through which the electronic device 101 may be connected to the earphone 405, and may be configured as an earjack for connection to an earphone or a headset.

While an earjack connected to an earphone plug is taken as an example of the connection member in describing a specific embodiment of the present disclosure, the connection member may be any of connection members including a plug for power connection, an interface connector installed to an information communication device and providing connectivity to an external device, such as an HDMI port or a charging port, a socket into which a storage medium is inserted, and an antenna socket with which a detachable antenna is engaged.

The connection member 420 may be formed in the form of a cylinder with one end opened, and a hole is formed in a body of the connection member 420, for allowing an earphone plug 410 to be inserted therethrough and thus connected thereto. The hole may be extended along a length direction of the body of the connection member 420.

The earphone 405 may include unit(s) worn on one or both of the ears of the user, for outputting a sound. A pair of units may be formed on end portions 401 and 402 of the ear phone 400, which are worn on the ears of the user and output sounds. In addition to a speaker, at least one microphone 401L or 402R may be provided on each of the end portions 401 and 402. Components of the earphone 405 which are inserted into both ears of the user, when the user wears the earphone 405, may be referred to as the end portions 401 and 402, earphone units, a pair of ear speakers for outputting audio signals, or earphone channels. For example, a component of the earphone 405, which is inserted into the right ear of the user, may be referred to as a right ear speaker of the earphone 405.

The electronic device 101 is configured to determine whether the end portions 401 and 402 of the earphone 405 are both inserted and inserted in the correct ears (as opposed to opposite ears). The end portions 401 and 402 include microphones 401L and 402R that can capture a sound by the speaker 282*b* of the electronic device. The microphones 401L and 402R convert the captured sound into an audio signal that is transmitted to the electronic device 101. Based on the audio signals received from microphones 401L and 402R, the orientation of the electronic device 101, and the location of the speaker 282*b* on the electronic device 101, the electronic device 101 can determine whether the end portions are both inserted in the correct ears of the user.

For example, speaker 282*b* is located on the bottom surface 400B near the right surface 400R. In certain embodiments, if the electronic device 101 is in landscape orientation, the speaker 282*b* is likely to be to the user 's right. If the end portion 401 is correctly inserted into the user 's left ear and the end portion 402 is correctly inserted in to the user 's right ear, the audio signal from the left microphone 401L will have a delay and a lower level compared to the audio signal from the right microphone 402R that are within respective thresholds. Based on the deviations from the foregoing, the electronic device 101 can determine whether one or both of the end portions 401 and 402 are not inserted, or are inserted in opposite ears.

Figure 4C:
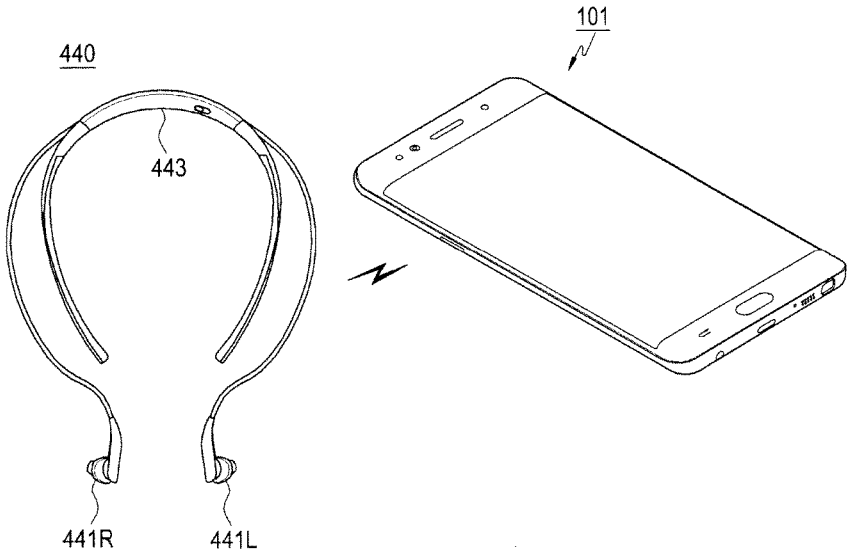
FIG. 4C is a schematic view of an electronic device and a headset connected to the electronic device according to various embodiments.

FIG. 4C is a schematic view of an electronic device and a headset connected to the electronic device according to various embodiments.

Referring to FIG. 4C, a headset 440 may include earphone units 441R and 441L connected to a body 443 by electrical wires. The earphone units 441R and 441L may be inserted into both ears of a user, respectively. The body 443 may include a C-shaped neck strap which may be worn around the neck of the user. The headset 440 may be communicably connected to the electronic device 101 and receive an audio signal from the electronic device 101. Speakers of the earphone units 441R and 441L may receive audio signals from the electronic device 101 through the electrical wires and output sounds. Further, upon input of the user's voice to a microphone included in the headset 440, the headset 440 may transmit the voice to the electronic device 101.

As described above, the earphone 405 (or the headset 440) connected to the electronic device 101 may receive an audio signal through at least one first microphone positioned on a first body of the earphone 405 (or the headset 440) and at least one second microphone positioned on a second body of the earphone 405 (or the headset 440). Therefore, an audio signal from the outside, for example, the electronic device 101 may be introduced into the first and second microphones of the earphone 405. The first body may be an earphone unit inserted into one of the ears of the user, and the second body may be an earphone unit inserted into the other ear of the user.

Further, a first speaker for outputting an audio signal may be disposed at a first position of the first body in the first earphone unit of the earphone 405 (or the headset 440), and thus the first microphone may be disposed at a second position of the first body. In the case of the earphone 405 (or the headset 440) having a plurality of microphones, a third microphone may be disposed at a third position of the first body. Meanwhile, a second speaker may be disposed at a first position of the second body, and thus the second microphone may be disposed at a second position of the second body in the second earphone unit. Further, in the case of the earphone 405 (or the headset 440) having a plurality of microphones, a fourth microphone may be disposed at a third position of the second body. The first speaker and the second speaker may be disposed at positions at which they are inserted into the ears of the user, when the earphone 405 (or the headset 440) is worn on the user. The first and second microphones may be exposed outward from the ears of the user, and the third and fourth microphones may be disposed at positions at which they are inserted into the ears of the user.

Figure 5:
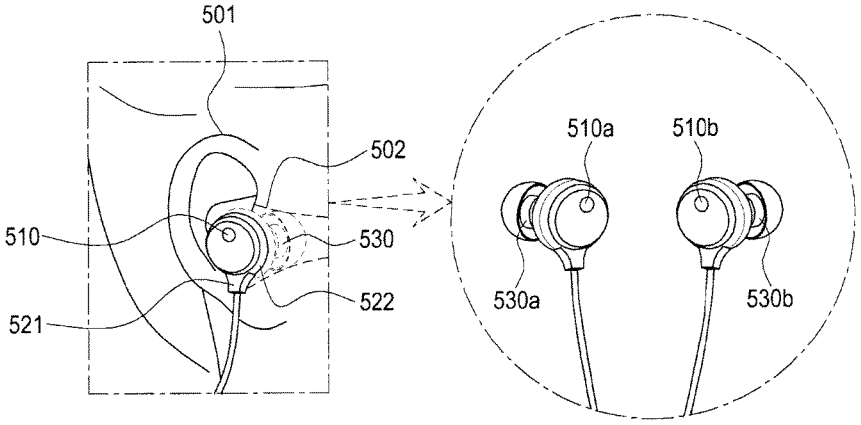
FIG. 5 is a view illustrating the configuration of an earphone according to various embodiments.

Reference will be made to FIG. 5 to describe the configuration of an earphone having the above-described earphone units in detail.

FIG. 5 is a view illustrating the configuration of an earphone according to various embodiments.

Each earphone unit of the earphone may include a speaker and at least one microphone. As illustrated in FIG. 5, an earphone unit 522 inserted into a user's ear 501 may include an ear microphone 510 disposed at a position exposed outward from the ear 501, an ear speaker disposed at a position where it is inserted in the inside 502 of the ear 501, a sound nozzle 521, and an ear tip 530. The earphone unit 522 may further include an additional microphone at a position opposite to the microphone 510, that is, at a position near to the speaker.

Further, earphone units 522 include ear tips 530*a* and 530*b* each having an elastomer member, thereby offering wearing comfort to the user. The ear tips 530*a* and 530*b* may be fixed on the outer circumferential surfaces of sound nozzles 521, and may be flexibly deformed adaptively to the shapes of the external auditory meatuses of the user, thereby offering wearing comfort to the user. While ear microphones 510*a* and 510*b* may collect voice signals of a speaker during a call, the ear microphones 510*a* and 510*b* may be attached in a direction opposite to the speakers in order to cancel noise in an environment with ambient noise.

Determining Earphone Non-Insertion or in Opposite Ears

Figure 6A:
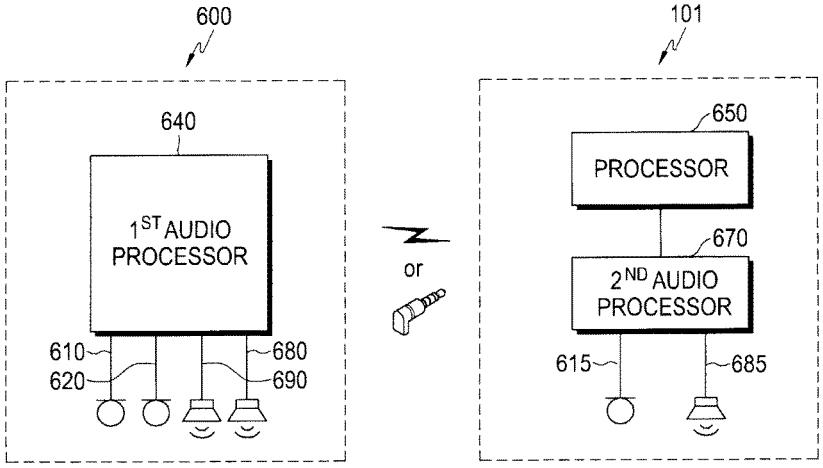
FIG. 6A is a block diagram of an earphone and an electronic device, for determining a positioning state of the earphone according to various embodiments.

FIG. 6A is a block diagram of an earphone and an electronic device, for determining a positioning state of the earphone according to various embodiments.

FIG. 6A illustrates a structure for determining a wrong positioning state of an earphone such as slip-off of one of left and right speakers of the earphone or exchanged insertion of the left and right speakers of the earphone.

Referring to FIG. 6A, an earphone 600 such as a wireless headset may include a first audio processor 640 for outputting an audio signal received from the electronic device 101 to speakers 680 and 690, and outputting audio signals received from first and second microphones 610 and 620 to the electronic device 101. If the earphone 600 is wirelessly connected to the electronic device 101, the earphone 600 may include a communication interface (not shown), and any of wireless communication modules capable of establishing a communication channel and transmitting and receiving signals on the communication channel in a short range by a communication scheme such as Bluetooth is available as the communication interface.

The first and second microphones 610 and 620 are earphone microphones (such as 401L and 402R) inserted into the respective ears of the user. The ear microphones 610 and 620, and may provide the electronic device 101 with first and second audio signals that are electrical signals converted from sound generated from the electronic device 101, such as from speaker 685, the voice of the user, an ambient noise input, and so on. While two microphones are shown in FIG. 6A as configured, each for one earphone unit, if two microphones are provided to each earphone unit, third and fourth microphones may be additionally shown in FIG. 6A.

The first audio processor 640 may convert the first audio signal received through at least one microphone (for example, the first microphone 610, the third microphone, and so on) disposed on a first body of the earphone 600 operatively connected to the electronic device 101, and the second audio signal received through at least one microphone (for example, the second microphone 620, the fourth microphone, and so on) disposed on a second body of the earphone 600 to digital data, and output the digital data to a processor 650 of the electronic device 101 by wired or wireless communication.

The electronic device 101 connected wiredly or wirelessly to the earphone 600 may include the processor 650 and a second audio processor 670.

The second audio processor 670 may process an audio signal to be output through a speaker 685, which has been generated by executing a voice call function, an audio file play function, a video recording function, or the like, and an audio signal received through a microphone 615. In the state where the earphone 600 is connected to the electronic device 101, the output audio signal may be output through the speakers 680 and 690 of the earphone 600, instead of the speaker 685.

The processor 650 may determine a positioning state of the earphone 600 based on the difference between the first and second audio signals by analyzing the first and second audio signals based on data received from the first audio processor 640. According to an embodiment, the processor 650 may compare the first and second audio signals based on at least one of frequency characteristics, a time delay, and a level difference between the two audio signals. The processor 650 may determine the positioning state of the earphone based on a result of the comparison between the first and second audio signals. Thus, the processor 650 may determine insertion or removal of earphone units, and an opposite positioning state such as exchange between the left and right earphone units or loose insertion of an earphone unit.

When an audio signal is output through the speaker 685 of the electronic device 101, the processor 650 may acquire a first audio signal corresponding to the audio signal through the first microphone 610 of the earphone 600, and a second audio signal corresponding to the audio signal through the second microphone 620 of the earphone 600. According to an embodiment, the processor 650 may acquire sensing information for use in detecting a direction in which the speaker 685 of the electronic device 101 faces through at least one sensor of the electronic device 101. The processor 650 may calculate a time delay and a level difference between the first and second audio signals using the acquired sensing information, and determine the positioning state of the earphone 600 based on at least one of the time delay and the level difference. For example, if the processor 650 uses the sensing information, the processor 650 may be aware of the posture of the electronic device 101, and thus determine in which direction between the left and right of the user the speaker 685 disposed on one surface of the electronic device 101 faces.

When the speaker 685 of the electronic device 101 faces the right direction of the user, if a played sound is output through the speaker 685, a time delay may occur between inputs of the played sound to the microphones 610 and 620 of the earphone 600, in consideration of the distance between the electronic device 101 and the earphone 600 (for example, an arm length of the user). The time delay may be about tens of samples according to an average user arm length. Further, when the speaker 685 of the electronic device 101 faces in the right direction of the user, the played sound output from the speaker 685 may be input first to the microphone of the earphone 6000 inserted into the right ear of the user, and then to the microphone of the earphone 600 inserted into the left ear of the user, at a lower level than that of the input to the right microphone of the earphone due to diffraction from the face or attenuation. In this manner, the processor 650 may use the sensing information in calculating the time delay and the level difference between the first audio signal received from the right microphone of the earphone and the second audio signal received from the left microphone of the earphone 600. Accordingly, the processor 650 may calculate the time delay and the level difference using the sensing information, and determine the positioning state of the earphone 600 based on the time delay and/or the level difference.

Specifically, the processor 650 may calculate a time delay by analyzing a played sound output through the speaker 685 of the electronic device 101 and signals received through the microphones 610 and 620 of both earphone units. Further, the processor 650 may calculate a level difference by analyzing a relationship between a signal received through the microphone 615 of the electronic device 101 and signals received through the microphones 610 and 620 of both earphone units. As the processor 650 calculates the time delay and the level difference, the processor 650 may notify the user of the current positioning state of the earphone 600 or correct an output signal according to the positioning state as well as determine the positioning state of the earphone 600.

In the state where the earphone 600 is operatively connected to the electronic device 101, the processor 650 may correct an audio signal to be played according to the positioning state of the earphone 600 and output the corrected audio signal through the speakers 680 and 690 of the earphone 600. Therefore, when the earphone 600 is normally worn, the resulting maximization of the quality of a played audio signal may lead to a better hearing environment for the user. On the other hand, even though the left and right speakers of the earphone are worn exchanged in position, audio signals corresponding to the left and right ears of the user are output by correction, thereby preventing degradation of the sound quality of the earphone and obviating the need for the user's changing the positioning state of the earphone. As a consequence, user convenience is increased.

During video or audio recording, the processor 650 may record a video or audio by correcting a microphone signal to be recorded. That is, even though the earphone is worn with the left and right speakers exchanged in position, microphone signals corresponding to the left and right of the user may be input through correction, thereby enabling recording of the surroundings without distortions.

Meanwhile, in the case where a signal sound generated from the electronic device 101 and ambient noise other than the voice of a speaker are introduced to the microphones 610 and 620 of the earphone 600, an operation of the processor 650 for determining the positioning state of the earphone 600 using the ambient noise will be described below with reference to FIG. 6B.

Figure 6B:
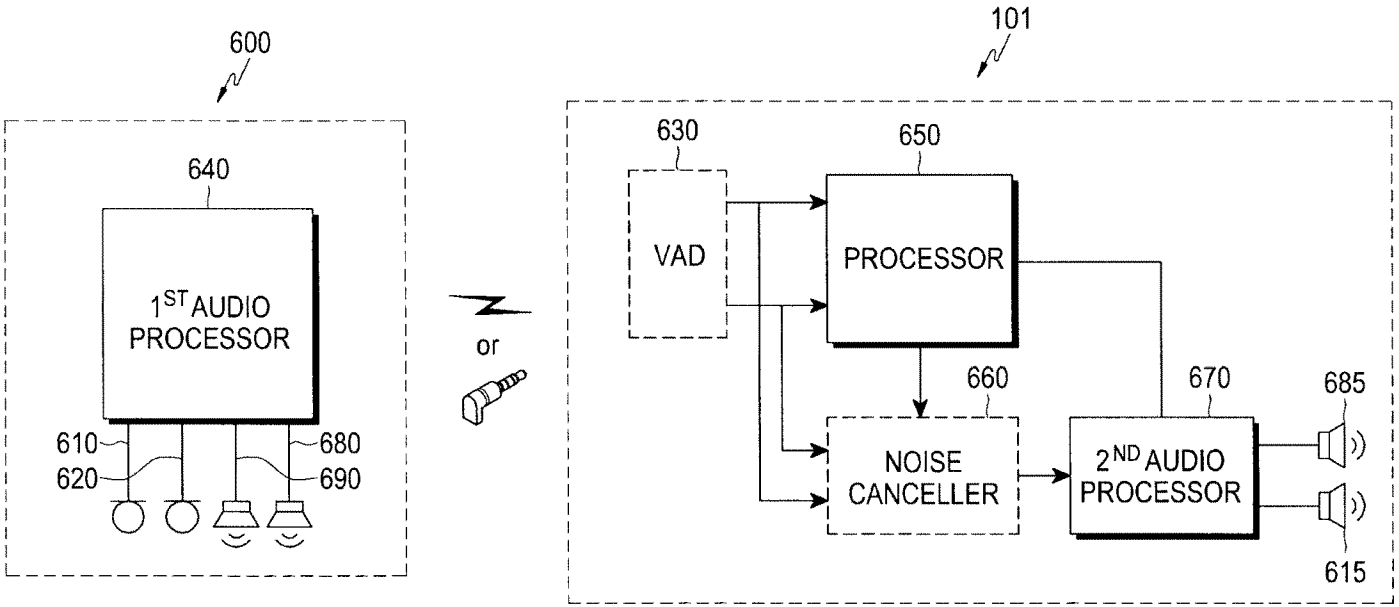
FIG. 6B is a block diagram of an earphone and an electronic device, for determining a positioning state of the earphone based on ambient noise according to various embodiments.

FIG. 6B is a block diagram of an earphone and an electronic device, for determining a positioning state of the earphone based on ambient noise according to various embodiments.

Referring to FIG. 6B, the first microphone 610 and the second microphone 620 operate in the same manner as described with reference to FIG. 6A. While a voice activity detector (VAD) 630 and a noise canceller 660 are added in FIG. 6B, by way of example, the VAD 630 and the noise canceller 660 may be incorporated into the processor 650.

The first audio processor 640 may convert an audio signal received from the at least one microphone 610 and 620 to digital data, and output the digital data to the processor 650.

The VAD 630 may determine whether the inputs from the first and second microphones 610 and 620 are the voice of a person or ambient noise. According to an embodiment, while only audio signals from the first and second microphones 610 and 620 are input to the VAD 630 through the first audio processor 640 in FIG. 6B, if two ear microphones are provided for each earphone unit, audio signals from third and fourth microphones may be provided to the VAD 630 along with the audio signals from the first and second microphones 610 and 620. Thus, it is to be understood that an audio signal from at least one microphone of the earphone 600 is provided to the VAD 630.

If the VAD 630 determines that the inputs (or sounds) received from the first and second microphones 610 and 620 are the voice of a person, the VAD 630 may provide first and second audio signals obtained by converting the voice to electrical signals to the processor 650. On the other hand, if the VAD 630 determines that the inputs (or sounds) received from the first and second microphones 610 and 620 are not the voice of a person, the VAD 630 may provide first and second audio signals obtained by converting the ambient noise inputs to electrical signals to the noise canceller 660.

The noise canceller 660 may perform a noise cancellation operation on the first and second audio signals under the control of the processor 650. The noise cancellation operation may be performed by, for example, active noise control (ANC), and may be an operation of cancelling or reducing noise included in the first and second audio signals. If ANC is adopted, one or more microphones may be used to pick up an ambient noise reference signal. The first and second microphones may be used to pick up the voice of the speaker and the third and fourth microphones may be used to pick up the external noise reference signal.

According to an embodiment, the processor 650 may represent the first and second audio signals as frequency bands in order to compare the first and second audio signals. The processor 650 may compare the first and second audio signals represented as the frequency bands, and determine whether the earphone 600 has been wrongly worn based on the difference between the first and second audio signals. Specifically, the processor 650 may compare the first and second audio signals based on at least one of frequency characteristics, a time delay, and a level difference, and determine whether the earphone 600 has been wrongly worn based on a result of the comparison.

For example, if the user starts a video recording mode in the state where the earphone 600 is connected to the electronic device 101, a notification message indicating 'a video will be recorded using earphone microphones' may be displayed on a screen of the electronic device 101, and at the same time, a start indication sound (an audio signal or signal sound indicating the start) may be output through the speaker 282*b* of the electronic device 101. Therefore, first and second audio signals corresponding to the start indication sound may be introduced to the first and second microphones 610 and 620 of the ear phone 600, and the processor 650 of the electronic device 101 may acquire the first and second audio signals corresponding to the start indication sound through the first and second microphones 610 and 620. The processor 650 may determine insertion or removal of the earphone units, and a wrong positioning state such as exchange between the left and right earphone units in position, or loose insertion of an earphone unit, based on at least one of the frequency characteristics, the time delay, and the level difference between the first and second audio signals.

Since the speaker of the electronic device 101 is disposed on the bottom surface 400B towards the bottom of the display 160*a* as illustrated in FIG. 4A, a time delay may occur between signals introduced to the first and second microphones 610 and 620 of the earphone 600 in the state where the earphone units are normally wom around the ears of the user. For example, in the case of sampling at a frequency of about 48K samples/sec, through the earphone microphones, a time delay of about 100-150 samples may occur between both microphones in consideration of an average user arm length.

According to an embodiment, if the time delay between the signals introduced to the first and second microphones 610 and 620 of the earphone 600 is outside a threshold range, the processor 650 may determine that the earphone has been removed. For example, if the time delay between the signals introduced to the first and second microphones 610 and 620 of the earphone 600 is less than a minimum delay threshold, which may mean that the distance between the first and second microphones 610 and 620 is less than a minimum distance threshold, the processor 650 may determine that both of the earphone units have been removed. If the time delay between the signals introduced to the first and second microphones 610 and 620 of the earphone 600 is greater than a maximum delay threshold, which may mean that the distance between the first and second microphones 610 and 620 is greater than a maximum distance threshold, the processor 650 may determine that at least one of the earphone units has been removed. The maximum and minimum delay thresholds will be described later in detail.

If the speaker 282*b* that outputs a played sound is disposed not at the center of the electronic device 101 but, for example, on the bottom surface 400B towards the right surface 400R of the electronic device 101, and the user grabs the center of the electronic device 101, inputs (or sounds) introduced to the first and second microphones 610 and 620 may be diffracted or attenuated due to the user's face or the like. Therefore, the signal input to the ear microphone in an opposite direction to the speaker 282*b* of the electronic device 101, e.g., the left side, may have a lower level than the signal input to the ear microphone in the same direction as the speaker of the electronic device 101. Thus, the levels of signals input to the first and second microphones 610 and 620 may be different.

According to an embodiment, if the level difference between the signals input to the first and second microphones 610 and 620 is less than a threshold, the processor 650 may determine a wrong positioning state of the earphone 600, in which the left and right speakers 680 and 690 are exchanged in position.

As described above, the processor 650 may determine the positioning state of the earphone 600 based on at least one of the time delay and the level difference between the first and second audio signals. Therefore, if each of the time delay and the level difference is less than a threshold, the processor 650 may determine the wrong positioning state of the earphone 600, in which the left and right speakers 680 and 690 are exchanged in position.

According to an embodiment, the processor 650 may detect the posture of the electronic device 101, for example, a direction in which the speaker of the electronic device 101 faces, based on sensing information received from at least one sensor of the electronic device 101. Therefore, in calculating at least one of the time delay and the level difference between the first and second audio signals, the processor 650 may determine a direction in which the speaker 685 faces, for example, whether the direction of the speaker 685 matches to the direction of the left or right earphone unit. Thus, the processor 650 may calculate at least one of the time delay and the level difference between the first and second audio signals, and determine the positioning state of the earphone 600 based on the at least one of the time delay and the level difference.

According to an embodiment, the processor 650 may determine the positioning state of the earphone 600 based on frequency characteristics as well as the time delay and the level difference between the first and second audio signals. The first and second audio signals have different frequency characteristics in a low frequency band according to the time delay between the first and second audio signals, and different signal levels in a high frequency band. Accordingly, the processor 650 may determine the positioning state of the earphone based on the above frequency characteristics.

Positioning states of the earphone may include at least one of normal insertion of the earphone into the respective ears of the user, removal of one of the left and right earphone units, removal of both of the earphone units, loose insertion of at least one of the earphone units, and exchanged insertion of the left and right earphone units. Further, the processor 650 may notify the user of a wrong positioning state of the earphone or may correct signals output through the earphone units according to play or recording.

The first audio processor 640 may convert an audio signal received from the processor 650 into an audible sound and output the audible sound through the first and second speakers 680 and 690 of the earphone 600. If the processor 650 detects the wrong positioning state of the earphone 600, the first audio processor 640 may switch signals to be output through the first and second speakers 680 and 690 of the earphone 600 under the control of the processor 650.

For example, if determining that the left speaker 680 supposed to be inserted into the left ear of the user and the right speaker 690 supposed to be inserted into the right ear of the user are inserted into the right and left ears of the user, respectively, the processor 650 may exchange left and right channels. Therefore, a signal intended for the right speaker 690 may be output through the left speaker 680, and a signal intended for the left speaker 680 may be output through the right speaker 690. In other words, the processor 650 may output a signal corresponding to a right audio signal through the channel of the left speaker 680 by correction.

During multi-microphone noise cancellation under the control of the processor 650, the noise canceller 660 may reduce noise included in at least one of the first and second audio signals by controlling parameters for multi-microphone noise cancellation. Further, if one of the left and right earphone units is removed, the noise canceller 660 may perform single-microphone noise cancellation on a signal for the other earphone unit under the control of the processor 650. Therefore, the noise canceller 660 may cancel noise included only in one of the first and second audio signals.

Figure 7A:
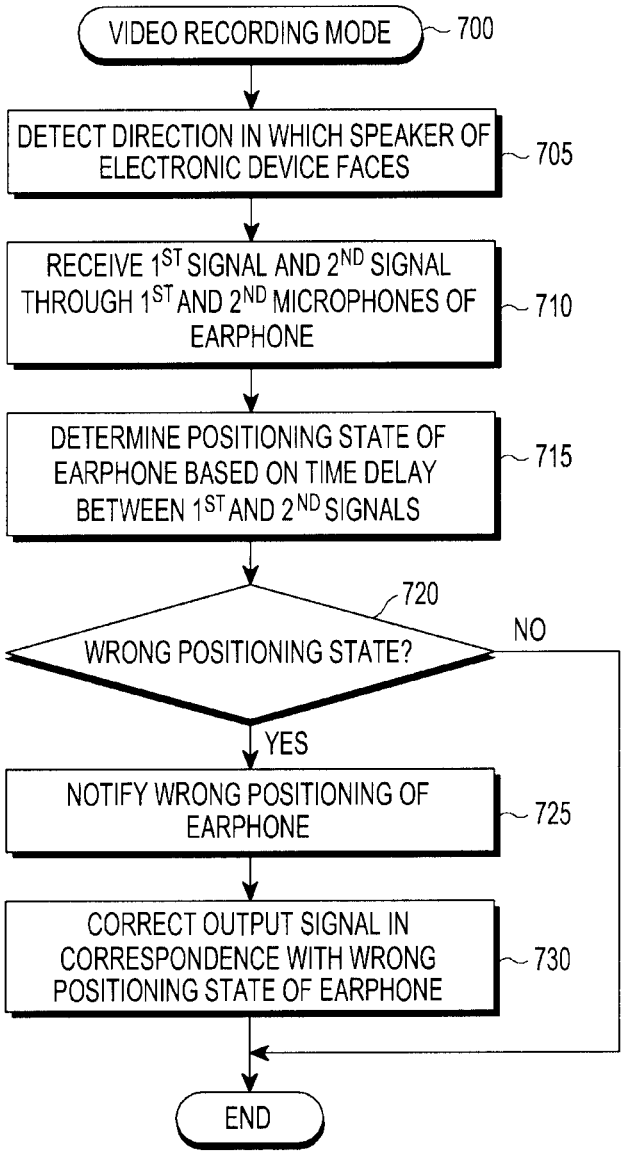
FIG. 7A is a flowchart illustrating an operation of an electronic device for determining a positioning state of an earphone in a video recording mode according to an embodiment.

FIG. 7A is a flowchart illustrating an operation of an electronic device for determining a positioning state of an earphone in a video recording mode according to an embodiment. A specific embodiment of the present disclosure is described in the context of an earphone as an example, and the earphone may be any of a wired earphone, a wireless earphone, and a wireless headset.

While the following description is given with a video recording mode taken as an example as a condition for determining a positioning state of the earphone, the same thing applies to any situation in which an audio signal may be input through an external microphone of the earphone, such as audio recording with the earphone connected to the electronic device 101.

Referring to FIG. 7A, the electronic device 101 may operate in the video recording mode in operation 700. When video recording starts in the video recording mode, the electronic device 101 may output a start indication sound indicating that the video recording mode has started. Herein, audio signals corresponding to the output of the start indication sound may be input to external microphones provided in the earphone connected to the electronic device 101 and provided to the electronic device 101. In this manner, the positioning state of the earphone such as insertion or removal of the earphone or exchange in position between the left and right earphone units may be determined based on the signals received through the left and right microphones of the earphone.

Before receiving the audio signals corresponding to the output of the start indication sound through the external left and right microphones of the earphone, the electronic device 101 should determine which of the left and right microphones of the earphone is closest to the speaker of the electronic device. For this purpose, the electronic device 101 may detect a direction in which the speaker of the electronic device 101 faces in operation 705.

Specifically, the electronic device 101 may detect the direction in which the speaker faces, based on sensing information sensed through the sensor module of the electronic device 101, for example, posture information about the electronic device 101. For example, if the video recording starts while the user grabs the electronic device 101 with the rear camera of the electronic device 101 facing backward, the speaker of the electronic device 101 may be nearer one of the left and right of the user. Herein, backward refers to a direction in which the rear surface of the electronic device 101 faces, and forward refers to a direction in which the front surface of the electronic device 101 faces. Forward may be one direction, and backward may be a direction opposite to the one direction.

Subsequently, the electronic device 101 may receive first and second signals through the first and second microphones of the earphone in operation 710. The first and second signals may include an audio signal corresponding to the output of the start indication sound. While the operation of receiving the first and second signals through the first and second microphones of the earphone is shown as performed after the operation of acquiring the sensing information used in detecting the direction in which the speaker faces in FIG. 7A, operations 705 and 710 may be performed at the same time and thus the sequence of operations is not limited to that illustrated in FIG. 7A.

Then, the electronic device 101 may determine a positioning state of the earphone based on a time delay between the first and second signals in operation 715. According to an embodiment, the electronic device 101 may determine the positioning state of the earphone based on a level difference between the first and second signals as well as the time delay between the first and second signals. An operation of calculating the time delay between the first and second signals and an operation of calculating the level difference between the first and second signals will be described later in detail.

In operation 720, the electronic device 101 may determine whether the determined positioning state is wrong. In the case of a wrong positioning state, the electronic device 101 may notify wrong positioning of the earphone in operation 725, and correct an output signal according to the wrong positioning state of the earphone in operation 730.

Figure 8A:
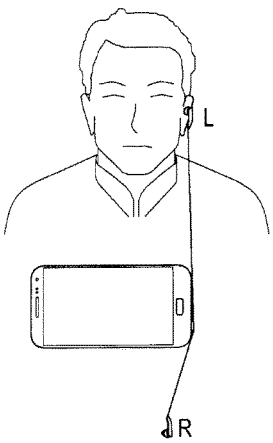
FIG. 8A, FIG. 8B, and FIG. 8C are exemplary views illustrating wrong positioning states of an earphone according to various embodiments.
Figure 8B:
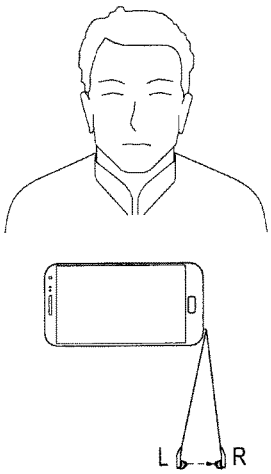
Figure 8C:
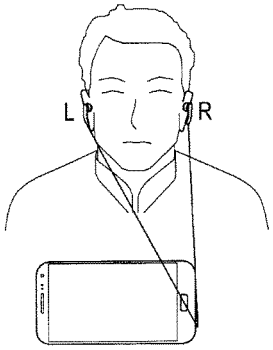

Reference will be made to FIGS. 8A, 8B, and 8C to describe an operation for correcting an output signal according to a wrong positioning state of an earphone. FIGS. 8A, 8B, and 8C are exemplary views illustrating wrong positioning states of an earphone according to various embodiments.

FIG. 8A illustrates a wrong positioning state of the earphone, in which the left earphone unit is normally inserted into the left ear of the user, and the right earphone unit is removed from the right ear of the user. FIG. 8B illustrates a wrong positioning state of the earphone, in which both earphone units are removed. FIG. 8C illustrates a wrong positioning state of the earphone, in which the right earphone unit is inserted into the left ear of the user, with the left earphone unit inserted into the right ear of the user, and thus the left and right earphone units are inserted into the wrong ears of the user.

The electronic device 101 may correct an output signal in different manners according to the wrong positioning states illustrated in FIGS. 8A, 8B, and 8C.

In the case where at least one of the left and right earphone units has been removed as illustrated in FIGS. 8A and 8B, the electronic device 101 may notify the user of the removal state of the earphone unit(s) by a warning sound or a warning screen. In the case where the left and right earphone units have been inserted exchanged in position as illustrated in FIG. 8C, the electronic device 101 may switch left and right channels corresponding to the earphone units with each other. For example, if the right earphone unit is inserted into the left ear of the user and the left earphone unit is inserted into the right ear of the user, the electronic device 101 may control exchanged output of signals through the speakers of the earphone units by switching left and right channels with each other.

Figure 7B:
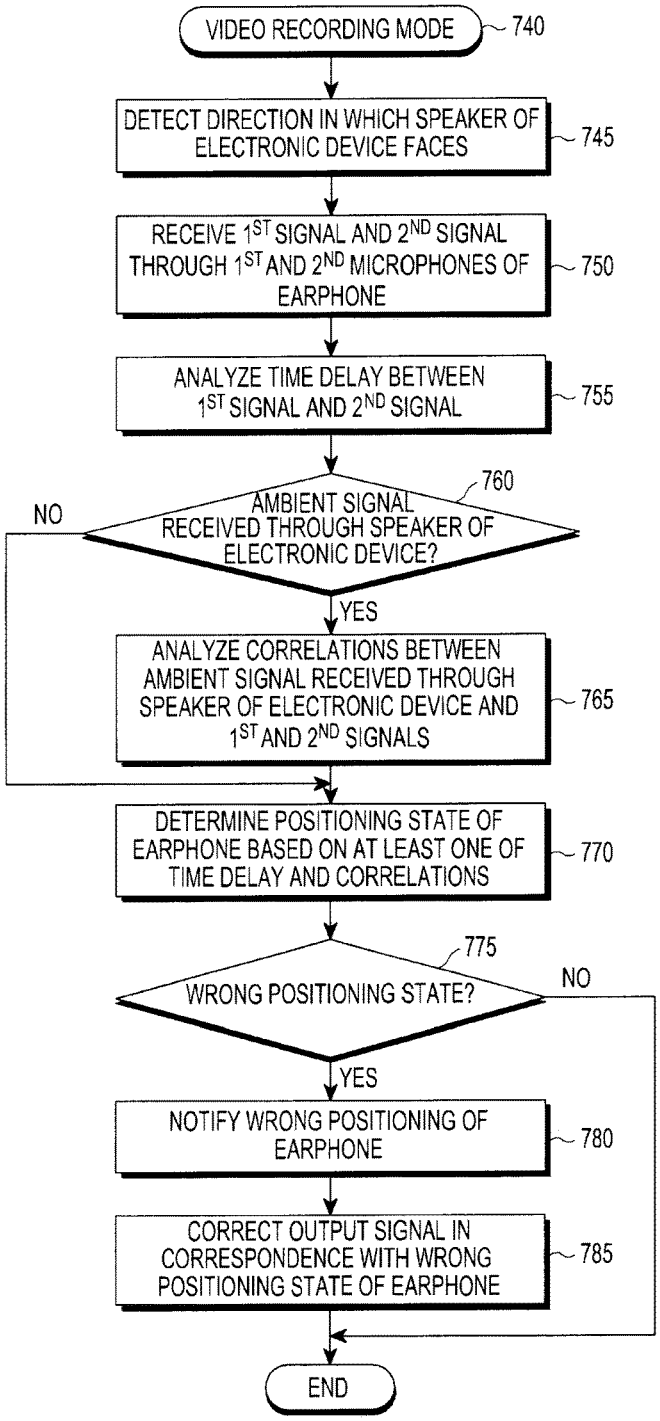
FIG. 7B is a flowchart illustrating an operation of an electronic device for determining a positioning state of an earphone according to another embodiment.

FIG. 7B is a flowchart illustrating an operation of an electronic device for determining a positioning state of an earphone according to another embodiment.

Operations 740 to 755 correspond to operations 700 to 715 of FIG. 7A, and operations 775 to 785 of FIG. 7B correspond to operations 720 to 730 of FIG. 7A. Notably, an additional operation for determining a wrong positioning state of the earphone by means of a signal input to a microphone of the electronic device 101 besides a time delay in the electronic device 101 is illustrated in FIG. 7B. For example, sounds such as the voice of a speaker, ambient noise, and so on may be input to at least one microphone of the electronic device during video recording or audio recording through a microphone.

Therefore, the electronic device 101 may determine whether an ambient signal (or sound) has been input through the microphone of the electronic device 101 in operation 760. If an ambient signal has not been input, the electronic device 101 may determine the positioning state of the earphone based on a time delay between first and second signals introduced to the first and second microphones of the earphone in operation 770. On the other hand, if an ambient signal has been input through the microphone of the electronic device 101 in operation 760, the electronic device 101 may analyze correlations between the ambient signal input to the microphone of the electronic device and the first and second signals in operation 765. Specifically, after frequency conversion of the ambient signal input to the microphone of the electronic device 101, the first signal, and the second signal, the electronic device 101 may calculate a correlation between the ambient signal and the first signal, and a correlation between the ambient signal and the second signal. Subsequently, the electronic device 101 may determine the positioning state of the earphone based on at least one of the time delay and the correlations in operation 770.

Figure 9A:
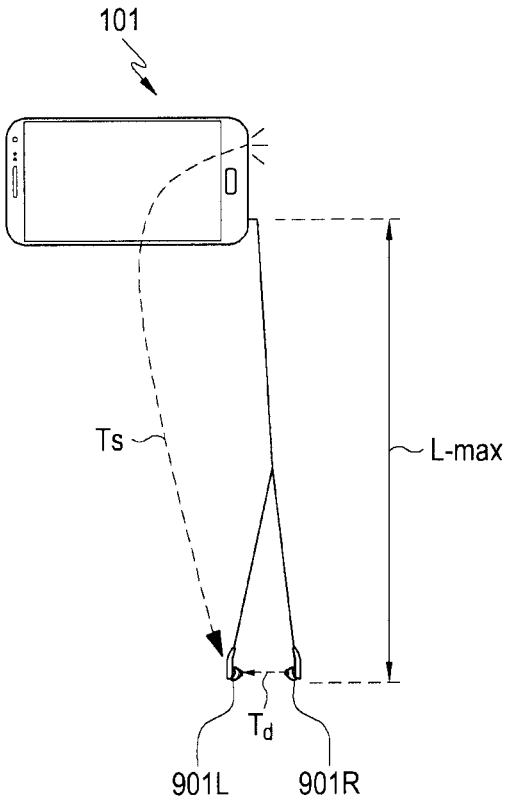
FIG. 9A is a view illustrating a time delay between signals input to left and right microphones of an earphone according to various embodiments.
Figure 9B:
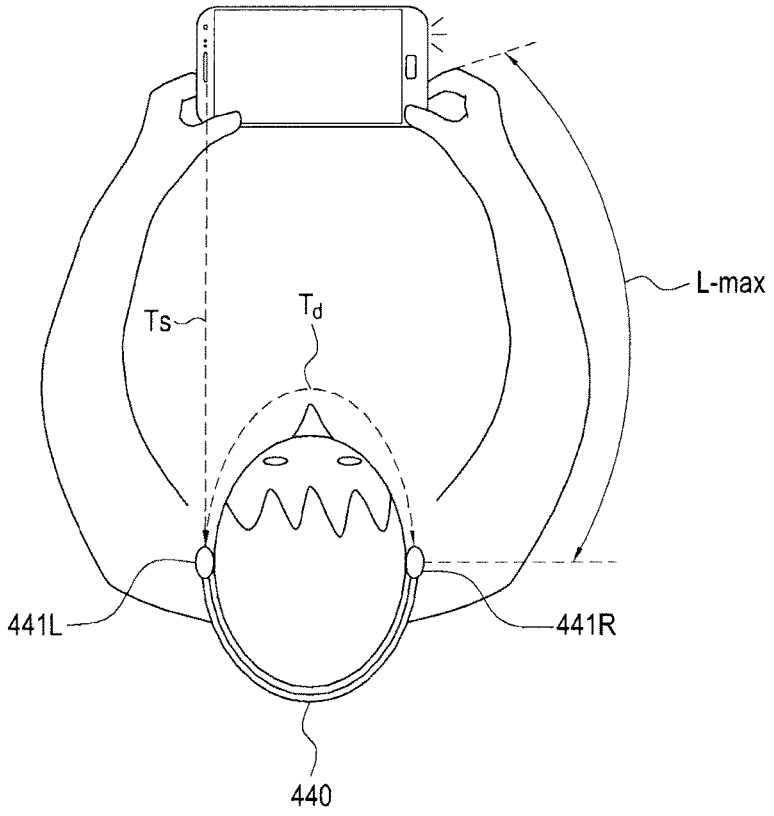
FIG. 9B is a view illustrating a time delay between signals input to left and right microphones of a headset according to various embodiments.

For example, when the electronic device 101 is turned to the landscape orientation as in FIG. 9A-9B, such that the microphone 288*a* is on the user's right hand side and microphone 288*b* is on the user's left hand side, the electronic device 101 illustrated in FIG. 4A may pick up ambient sounds from each direction, and at the same time, each ear microphone may also pick up an ambient sound. Accordingly, the electronic device 101 may determine the position of the earphone based on correlations among signals received through the four microphones. For example, since a correlation between a microphone signal of the electronic device and an ear microphone signal in the same direction is high, the electronic device 101 may determine whether the earphone has normally been worn based on a result of comparing the correlations.

For example, the electronic device 101 may calculate a correlation between same-direction signals, that is, between a right microphone signal of the earphone and a right microphone signal of the electronic device, e.g., microphone 288*b* in the scenario described in FIG. 9A, 9B, and a correlation between different-direction signals, that is, between a left microphone signal of the earphone and the right microphone signal of the electronic device. The correlation between the right microphone signal of the earphone and the right microphone signal of the electronic device may be higher due to the same direction than the correlation between different-direction signals. However, if the correlation between the left microphone signal of the earphone and the right microphone signal of the electronic device is higher than the correlation between same-direction signals, that is, the correlation between the right microphone signal of the earphone and the right microphone signal of the electronic device, that is, if the correlations are calculated as a switched values, it may be determined that the earphone has been wrongly positioned. That is, the electronic device 101 may determine based on the calculated correlations that the left and right earphone microphones have been exchanged in position. In certain embodiments, the same correlations can be determined between the left microphone signal of the electronic device, e.g., microphone 288*a* in the scenario described in FIG. 9A, 9B.

Because the time delay and correlations may be changed according to at least one of a speaker direction and a microphone direction of the electronic device 101, at least one of the speaker direction and the microphone direction of the electronic device 101 may be corrected using posture information about the electronic device 101. Therefore, the electronic device 101 may use the corrected speaker and microphone directions in calculating a time delay and correlations.

Now, a detailed description will be given of a method for calculating a time delay and correlations.

FIG. 9A is a view illustrating a time delay (such as during steps 715, 755) and a level difference between signals input to left and right microphones of an earphone according to various embodiments.

Referring to FIG. 9A, when the user presses a start button for video recording or ear microphone-based audio recording, a start indication sound may be output through a speaker of the electronic device 101. Left and right microphones 901L and 901R of the earphone may acquire first and second audio signals corresponding to the start indication sound, respectively. The first and second audio signals corresponding to the start indication sound may be initial signals based on which it is determined whether the earphone has been wrongly positioned. Since the cord of the earphone has a fixed length, a maximum distance between the electronic device 101 and the earphone connected to the electronic device 101 may be determined. Let the maximum distance between the earphone and the electronic device 101 be denoted by L-max. Then, a time difference (or a time delay) may occur between a time of outputting the start indication sound through the microphone of the electronic device 101 and a time of introducing an audio signal corresponding to the start indication sound to an ear microphone. If the time difference is Ts, Ts may be calculated by equation (1).

$$T_S = L\text{-max}/C \tag{1}$$

where C represents the velocity of sound and L-max represents the maximum distance between the earphone and the electronic device 101. Thus, Ts may represent a time threshold determined in consideration of the maximum distance between the earphone and the electronic device 101 and the velocity of sound.

As illustrated in FIG. 9A, a time delay may also occur between a time of introducing the audio signal corresponding to the start indication sound to the left microphone 901L of the earphone and the right microphone 901R of the earphone. If the time delay between the left and right microphones 901L and 901R is 'Td', Td may correspond to a maximum correlation between a signal x_L of the left microphone 901L and a signal x_R of the right microphone 901R. The correlation between the signal x_L of the left microphone 901L and the signal x_R of the right microphone 901R may be calculated by equation (2) for delay m. The Td between signals x_L and $x_{13}$ R is based on the value m that results in the largest R(m).

$$R(m) = \sum_{n=0}^{N-m-1} x_L_{n+m} x_R_n \tag{2}$$

where x_L may represent the signal introduced to the left microphone 901L, and x_R may represent the signal introduced to the right microphone 901R. To reduce a time delay error, the time delay may be calculated for signals in a frequency band less affected by reflection or diffraction. For example, since an audio signal in a low frequency band is introduced to a microphone with less influence of reflection or diffraction, the electronic device 101 may calculate a time delay in low-frequency band signals using a low pass filter (LPF).

As illustrated in FIG. 9A, if a wired earphone is connected to the electronic device 101, the maximum distance between the electronic device 101 and the connected earphone may be determined according to the length of the cord of the earphone. In contrast, if an earphone such as a wireless earphone or a headset is connected wirelessly to the electronic device 101, the maximum distance may be determined in the following manner.

FIG. 9B is a view illustrating a time delay between signals input to left and right microphones of a headset according to various embodiments.

As illustrated in FIG. 9B, if the user wearing the earphone 440 such as a wireless earphone or a headset records a video using the electronic device 101, the user may record a video, viewing a forward image displayed on a front display of the electronic device 101. Since the earphone 440 is wirelessly connected to the electronic device 101, a maximum distance between the earphone 440 and the electronic device 101 may be determined according to a maximum arm length of an average person in the wireless connected state. In FIG. 9B, therefore, 'L-max' may represent the maximum arm length of an average person, and 'Ts' may be calculated by equation (1). As in FIG. 9A, 'Td' may represent a time delay between the left and right microphones 441L and 441R of the earphone 440 in FIG. 9B.

As illustrated in FIGS. 9A and 9B, a time difference may occur between signals input to the left and right microphones 441L and 441R of the earphone 440, and with the left and right microphones 441L and 441R worn on both ears of the user, a level difference may also occur between the left and right microphones 441L and 441R of the earphone 440.

Figure 9C:
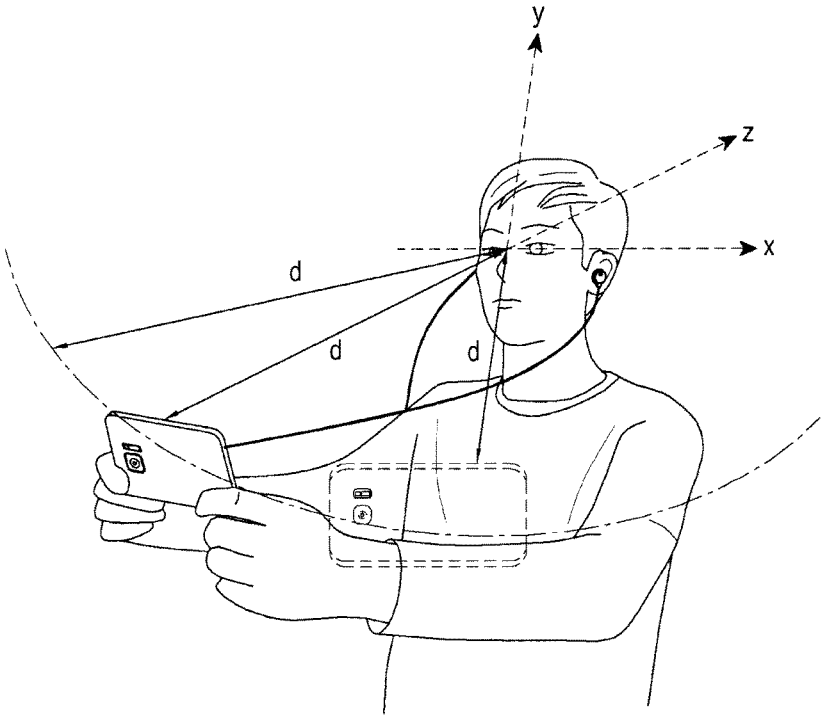
FIG. 9C and FIG. 9D are views illustrating a relationship between the position of an electronic device and the position of a user according to various embodiments.
Figure 9D:
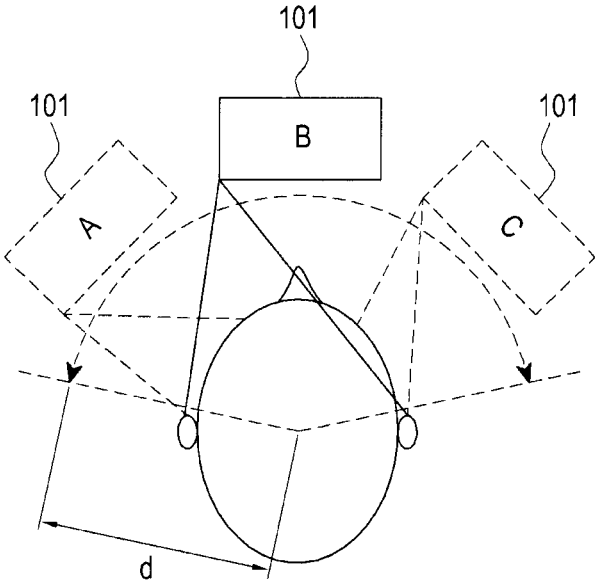

For example, if the user records a video, grabbing the electronic device 101 with both hands as illustrated in FIG. 9C, the user may generally record a video or audio, maintaining a predetermined distance d to the electronic device 101 with respect to a reference axis (for example, y axis). Even though the user captures images, while moving the electronic device 101 to positions A, B, and C, as seen from the above as illustrated in FIG. 9D, it may be assumed that the electronic device 101 is maintained to be apart from the face center or body of the user by a predetermined distance, for example, 20 cm (8 in) in consideration of the length of the cord of the earphone and the arm length of the user. FIGS. 9C and 9D are views illustrating a relationship between the position of an electronic device and the user of a user according to various embodiments.

For example, in the case where the user records a video, grabbing the electronic device 101 with both hands as illustrated in FIG. 9C, if the speaker of the electronic device 101 faces in the left direction of the user, a signal input to the right microphone 901R is slightly affected by reflection or diffraction from the face of the user and thus may have a lower level than a signal input to the left microphone 901L. If the level difference between the signal x_L of the left microphone 901L and the signal x_R of the left microphone 901R is 'Ld', Ld may represent a root mean square (RMS) difference between the signal x_L of the left microphone 901L and the signal x_R of the right microphone 901R. That is, Ld may represent a statistic value of the magnitudes of changing values between the signal x_L of the left microphone 901L and the signal x_R of the left microphone 901R. To reduce a level difference error, a level difference between signals in a frequency band affected much by the face of the user may be calculated. For example, since the level difference between left and right audio signals in a high frequency band is wide, the electronic device 101 may calculate a level difference between high-frequency band signals, using a high pass filter (HPF).

Meanwhile, it may be determined whether the earphone has been wrongly positioned, based on a correlation between a signal input through the microphone of the electronic device 101 and a signal input through each ear microphone.

If the correlations between signals in the same direction, that is, the correlation between a left microphone signal of the earphone and a left microphone signal of the electronic device is 'C_LL', the correlation between a right microphone signal of the earphone and a right microphone signal of the electronic device is 'C_RR', the correlations between signals in different directions, that is, the correlation between the left microphone signal of the earphone and the right microphone signal of the electronic device is 'C_LR', and the correlation between the right microphone signal of the earphone and the left microphone signal of the electronic device is 'C_RL', the correlations 'C_LL', 'C_RR', 'C_LR', and 'C_RL' may be calculated. When one microphone is provided at a portion of the electronic device, correlations may be calculated in the same manner as described above. In this manner, the electronic device 101 may acquire coherence on a frequency band basis.

If a time delay Td, a level difference Ld, and a correlation between the earphone and the electronic device 101 in the above manner, the electronic device 101 may determine the positioning state of the earphone using at least one of the time delay Td, the level difference Ld, and the correlation.

First, reference will be made to FIG. 10A to describe a method for determining an earphone positioning state using the time delay Td.

Figure 10A:
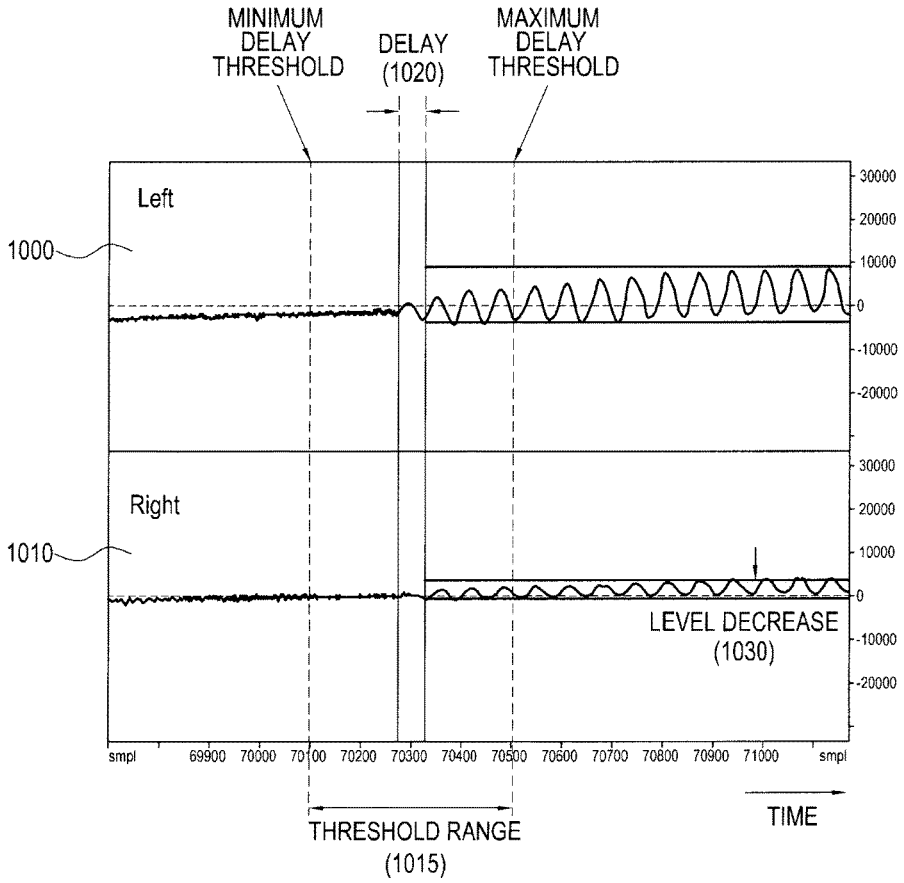
FIG. 10A is a graph illustrating a time delay between microphones of an earphone according to various embodiments.

FIG. 10A is a graph illustrating a time delay between microphones of an earphone according to various embodiments.

FIG. 10A is an exemplary view illustrating signals introduced to the left and right microphones of the earphone. In FIG. 10A, the horizontal axis represents time (or samples—with a constant sampling rate, the sample number will have a direct correspondence with time), and the vertical axis represents amplitude. As illustrated in FIG. 10A, a time delay 1020 may occur between an audio signal 1000 introduced to the left microphone of the earphone and an audio signal 1010 introduced to the right microphone of the earphone. The time delay may follow a time period when a start indication sound is output from the electronic device 101 and input to the microphones, that is, a time when an audio signal corresponding to the start indication sound is initially input.

If a time delay occurs between the audio signal 1000 introduced to the left microphone of the earphone and the audio signal 1010 introduced to the right microphone of the earphone, the electronic device 101 may determine whether the time delay Td is within a threshold range between a maximum delay threshold and a minimum delay threshold. The maximum delay threshold is the maximum of time delays when the ear microphones are positioned on both ears of the user, and the minimum delay threshold is the minimum of the time delays when the ear microphones are positioned on both ears of the user.

If the time delay Td is within the threshold range, the electronic device 101 may determine that both of the earphone microphones have been worn normally. However, if the time delay Td is greater than the maximum delay threshold or less than the minimum delay threshold, the electronic device 101 may determine that the earphone has been removed. If the time delay is less than the minimum delay threshold, the electronic device 101 may also determine that the left and right earphone units of the earphone have been exchanged in position.

As illustrated in FIG. 10A, it is noted that the level difference between the audio signal 1000 received through the left microphone of the earphone and the audio signal 1010 received through the right microphone of the earphone is wide in a high frequency band. Therefore, the decrease 1030 of the level of the audio signal 1010 received through the right microphone of the earphone may mean that the right microphone of the earphone is farther from the speaker of the electronic device 101.

Therefore, if the time delay Td is greater than zero and the level difference Ld is also greater than zero, each microphone of the earphone may be in a normal positioning state. On the other hand, if the time delay Td is less than zero and the level difference Ld is also less than zero, the left and right microphones of the earphone may be exchanged in position.

Figure 10B:
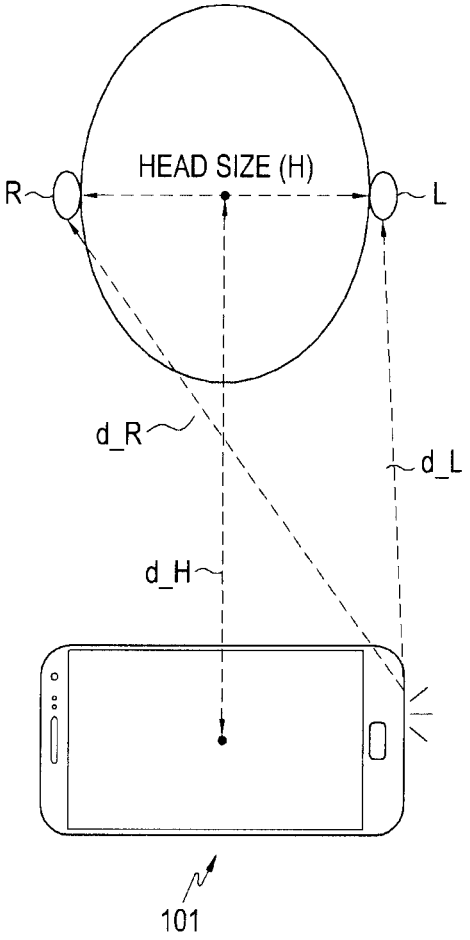
FIG. 10B is a view illustrating a method for determining a maximum delay threshold and a minimum delay threshold for microphones of an earphone according to various embodiments.

FIG. 10B is a view illustrating a method for calculating a maximum delay threshold and a minimum delay threshold for each microphone of an earphone according to various embodiments.

In FIG. 10B, let a head size be denoted by 'H' and the distance between the head and the electronic device 101 be denoted by 'd_H'. Then, with earphone units R and L normally inserted in both ears of the user, a time of arrival of a start indication sound from the speaker of the electronic device 101 to the right earphone unit R is 'd_R' and a time of arrival of the start indication sound from the speaker of the electronic device 101 to the left earphone unit R is 'd_L'.

For example, on the assumption that the head size H of an ordinary person is about 25 cm/9.84 in and the distance H between the head and the electronic device 101 is about 30 cm/11.81 in, with the earphone units R and L normally inserted into both ears of the user, the time delay between the earphone units R and L may be within about 10 to 15 samples, for example, about 14 samples in an sampling environment of about 48 kHz. However, if the left and right earphone units are exchanged in position, the time delay may have a negative sample value. If one earphone has slipped off from an ear or the distance between the two earphone units becomes wide, the time delay may have a value of about 30 or more samples. Thus, a maximum delay threshold may be set to 30 samples, a minimum delay threshold may be set to 5 samples, and the electronic device 101 may determine whether the earphone has been normally worn based on the maximum and minimum delay thresholds.

Figure 10C:
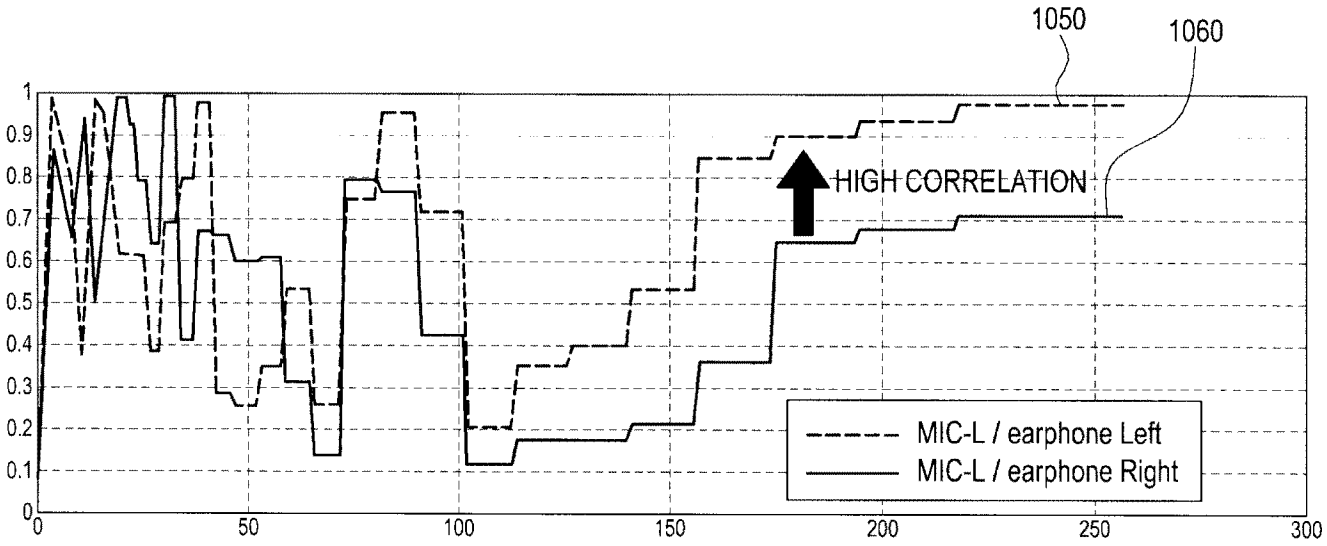
FIG. 10C is a graph illustrating correlations between a microphone signal of an electronic device and microphone signals of an earphone according to various embodiments.

FIG. 10C is a graph illustrating correlations between a microphone signal of an electronic device and each microphone signal of an earphone according to various embodiments.

In FIG. 10C, 'C_LL' denotes a correlation between same-direction signals, that is, a left microphone signal of the earphone and a left microphone signal of the electronic device, and 'C_RL' denotes a correlation between a right microphone signal of the earphone and the left microphone signal of the electronic device. The correlations 'C_LL' 1050 and 'C_RL' 1060 are illustrated. The left microphone signal of the electronic device may be a signal input through a microphone disposed on one side surface (for example, on the left side surface with respect to the user), when the user grabs the electronic device 101 in the manner illustrated in FIG. 9C. It is noted from FIG. 10C that the correlation between same-direction signals is high. Accordingly, if the correlation between same-direction signals is higher than the correlation between different-direction signals, it may be determined that the earphone has been normally worn. For example, the correlations between same-direction signals, 'C_LL' and 'C_RR' may be compared with a correlation threshold, and if the correlations are less than the threshold, it may be determined that the earphone has been removed. The correlation threshold may be a lowest reference value of coherence between microphones at positions at which the microphones are worn.

If the correlation between same-direction signals is lower than the correlation between different-direction signals, the electronic device 101 may determine that the earphone microphones have been exchanged in position. For example, if 'C_RL' is higher than 'C_LL', the electronic device 101 may determine that the earphone microphones have been exchanged in position. Since the correlation between same-direction signals is usually higher than the correlation between different-direction signals, if the latter is higher than the former, this may mean that the earphone microphones have been exchanged in position.

Upon occurrence of the above earphone wrong positioning state, for example, upon occurrence of at least one of removal of one of the left and right earphone units, removal of both of the earphone units, loose insertion of at least one of the earphone units, and exchanged insertion of the left and right earphone units, the electronic device 101 may notify the user of the wrong positioning state of the earphone, or correct an output signal.

Figure 11:
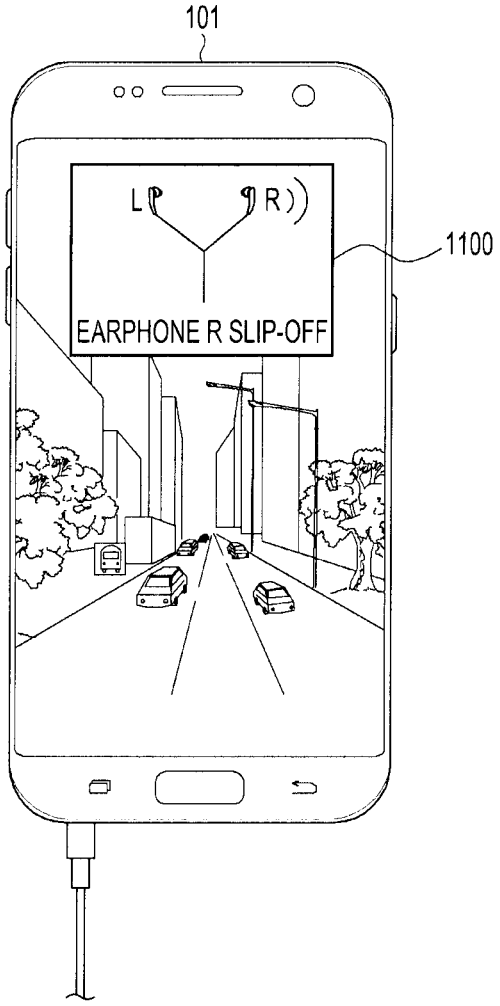
FIG. 11 is an exemplary view illustrating a screen indicating wrong positioning of an earphone according to various embodiments.

FIG. 11 is an exemplary view illustrating a screen indicating wrong positioning of an earphone according to various embodiments. Referring to FIG. 11, upon detection of wrong positioning of the earphone when a video recording mode starts, a wrong positioning notification 1100 may be displayed on a screen. The electronic device 101 may notify the user of the wrong positioning of the earphone by a screen, a warning sound, vibrations, or the like.

Figure 12:
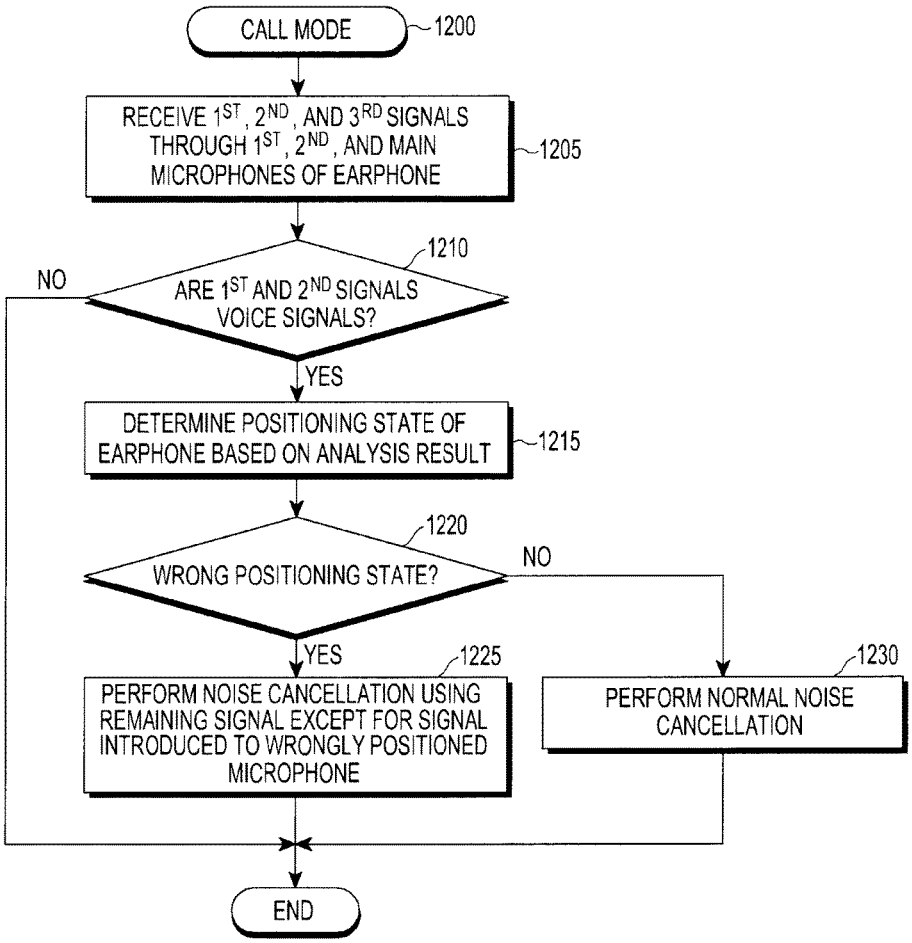
FIG. 12 is a flowchart illustrating an operation of an electronic device for determining a positioning state of an earphone in a call mode according to an embodiment.

FIG. 12 is a flowchart illustrating an operation of an electronic device for determining a positioning state of an earphone in a call mode according to an embodiment. In FIG. 12, an operation for determining wrong positioning of an earphone using a voice signal during a call is illustrated.

Referring to FIG. 12, when a call mode starts in operation 1200, the electronic device 101 may receive a first signal, a second signal, and a third signal through first and second microphones (for example, a microphone of a right earphone unit and a microphone of a left earphone unit), and a main microphone of the earphone in operation 1205. Then, the electronic device 101 may determine whether the first and second signals are voice signals in operation 1210. For example, the electronic device 101 may determine whether the signals received through the first and second microphones are the voice of a person or ambient noise by VAD.

Figure 13A:
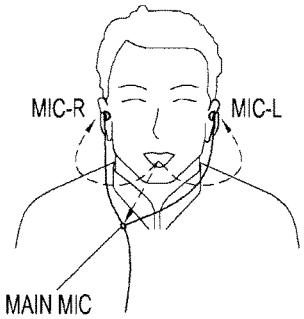
FIG. 13A and FIG. 13B are exemplary views illustrating voice input to microphones of an earphone according to various embodiments.
Figure 13B:
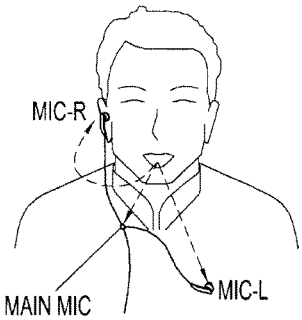

FIGS. 13A and 13B are exemplary views illustrating input of voice to microphones of an earphone according to various embodiments. During a call, a user's voice may be input to the left, right, and main microphones of the earphone, as illustrated in FIGS. 13A and 13B. While the main microphone is shown in FIGS. 13A and 13B as positioned at the center connecting both ear microphones to each other, the main microphone may be a microphone of the electronic device 101 in the case of a wireless headset or a wireless earphone.

As illustrated in FIG. 13A, with the ear microphones normally worn on the ears of the user, the user's voice may be input to each ear microphone. However, if one of the ear microphones has slipped off from an ear as illustrated in FIG. 13B, more ambient noise than the user's voice may be input to the slipped-off ear microphone. Therefore, in the state where at least one ear microphone has been removed during a call, voice quality may be ensured by controlling a parameter for multi-microphone noise cancellation or performing a single-microphone noise cancellation operation.

Thus, if the first and second signals are voice, the electronic device 101 may determine the positioning state of the earphone based on an analysis result in operation 1215. That is, if voice signals are input to the first and second microphones, the positioning state of the earphone may be determined based on the result of comparing the voice signal input to the first microphone with the voice signal input to the second microphone. On the other hand, if determining that the first and second signals are not voice signals in operation 1210, the electronic device 101 may end the call mode. Specifically, if the first and second signals are voice signals, a correlation between the two voice signals may be calculated. As illustrated in FIG. 13A, because the distances between the mouth and the ears are equal, if the microphones are normally worn on the ears, the distances between the mouth of the speaker and the ear microphones are equal, and thus a time delay within a threshold range, frequency characteristics, and a level difference may occur between voice signals input to the microphones.

Accordingly, the electronic device 101 may determine whether the earphone has been normally worn based on the time delay, frequency characteristics, and/or level difference in operation 1220. If the time delay is outside a threshold range, the level difference is less than a threshold, or the like, it may be determined that the earphone has been wrongly positioned. Therefore, if the wrong positioning state of the earphone is determined in operation 1220, a noise cancellation operation may be performed using the remaining microphone signals except for a signal introduced to a wrongly positioned microphone in operation 1225. Or noise may be canceled by controlling a noise cancellation parameter.

In contrast, in the normal positioning state of the earphone, the electronic device 101 may perform a normal noise cancellation operation in operation 1230. If the earphone has been normally worn, the electronic device 101 may perform a multi-microphone noise cancellation operation on a combination of at least two of the first, second, and third signals input through the first and second microphones and the main microphone. That is, noise included in the input voice signals may be cancelled or reduced.

Figure 14A:
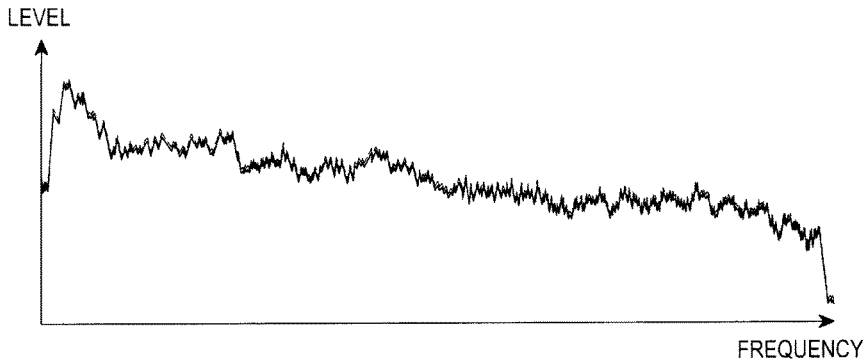
FIG. 14A and FIG. 14B are graphs illustrating output characteristics of voice signals according to the positions of microphones in an earphone during voice input according to various embodiments.
Figure 14B:
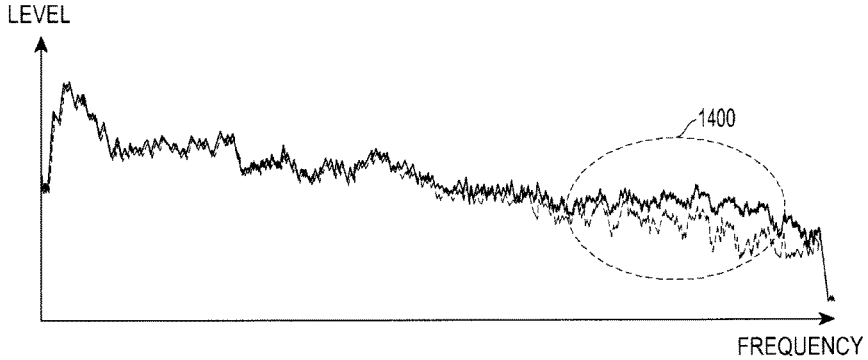

FIGS. 14A and 14B are graphs illustrating output characteristics of voice signals according to the positions of microphones provided in an earphone during voice input according to various embodiments.

FIG. 14A is an exemplary view illustrating frequency characteristics of two ear microphones normally positioned during a call, and FIG. 14B is an exemplary view illustrating frequency characteristics of two ear microphones wrongly positioned during a call. While signals of the normally positioned two ear microphones are identical in frequency characteristics as illustrated in FIG. 14A, signals of the wrongly positioned two ear microphones may have different frequency characteristics 1400 as illustrated in FIG. 14B. For example, if the left and right ear microphones are positioned on each ears of the user, a first distance between a mouth of the user and the left ear microphone may be similar to a second distance between the mouth of the user and the right ear microphone. And, if the first distance is similar to the second distance, a first signal of the left ear microphone and a second signal of the right ear microphone may be identical in frequency characteristics as illustrated in FIG. 14A. If the left ear microphone is positioned on one of the ears of the user and the right ear microphone is not positioned on both ears of the user, a first distance between the mouth of the user and the left ear microphone may be different from a second distance between the mouth of the user and the right ear microphone. And, if the first distance and the second distance are different, a first signal of the left ear microphone and a second signal of the right ear microphone may have different frequency characteristics 1400 as illustrated in FIG. 14B.

Figure 15:
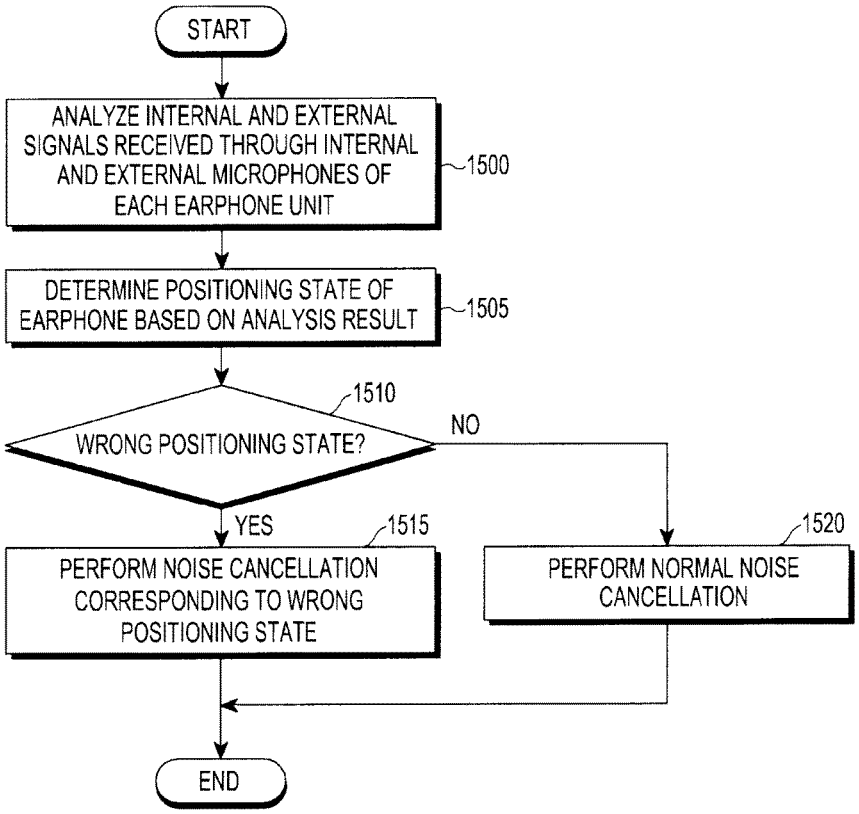
FIG. 15 is a flowchart illustrating an operation of an electronic device for determining a positioning state of an earphone, using internal and external microphones of the earphone according to various embodiments.

FIG. 15 is a flowchart illustrating an operation of an electronic device for determining a positioning state of an earphone, using internal and external microphones of the earphone according to various embodiments. In FIG. 15, in the case where two microphones are installed to each earphone unit, an operation of determining a wrong positioning state of the earphone using a signal input to each microphone, that is, signals input to the four microphones is illustrated.

Referring to FIG. 15, the electronic device 101 may analyze internal and external signals corresponding to a user's voice, ambient noise, and so on received through an internal microphone of each earphone unit (for example, an internal microphone of a right earphone unit and an internal microphone of a left earphone unit) and an external microphone of each earphone unit (for example, an external microphone of the right earphone unit and an external microphone of the left earphone unit) in operation 1500. In operation 1505, the electronic device 101 may determine the positioning state of the earphone based on the result of analyzing the internal and external signals.

For example, the external microphones of the left and right earphone units are exposed outward from both ears of the user, and the internal microphones of the left and right earphone units are inserted into both ears of the user. Then, the electronic device 101 may determine the positioning state of the earphone using correlations between the signals input to the microphones. Specifically, the electronic device 101 may calculate the correlation between signals input to the internal and external microphones of the right earphone unit, and the correlation between signals input to the internal and external microphones of the left earphone unit. If at least one of the calculated correlations is higher than a threshold, the electronic device 101 may determine a wrong positioning state of the earphone, such as loose positioning or slip-off of at least one earphone unit.

Therefore, the electronic device 101 may determine whether the earphone is in a wrong positioning state in operation 1510. In the case of the wrong positioning state of the earphone, the electronic device 101 may perform a noise cancellation operation corresponding to the wrong positioning state in operation 1515. For example, if at least one of the calculated correlations is higher than the threshold, the electronic device 101 may cancel noise in the signals input to the other microphones except for the signals input to microphones having correlations higher than the threshold. On the contrary, in the case of a normal positioning state in operation 1510, the electronic device 101 may perform a normal noise cancellation operation in operation 1520. Reference will be made to FIGS. 16A to 18B to describe the above operation in detail.

Figure 16A:
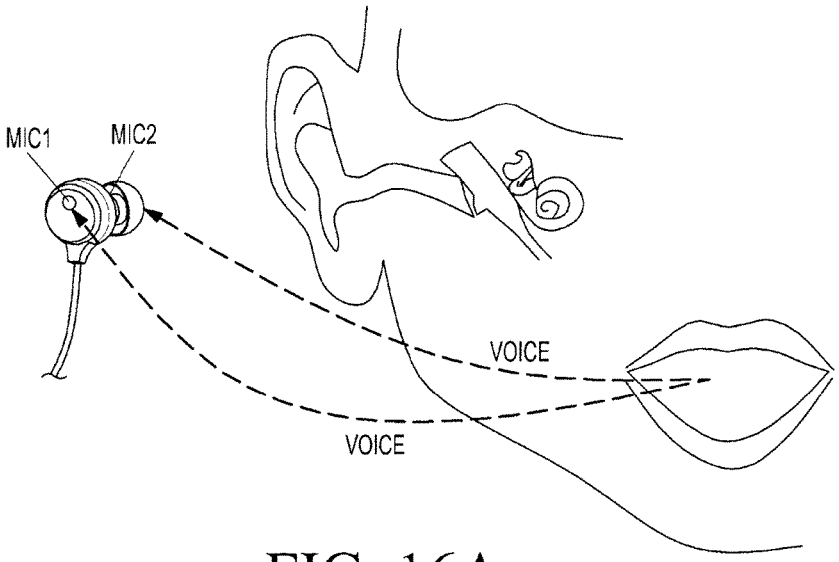
FIG. 16A and FIG. 16B are exemplary views illustrating voice signals introduced to internal and external microphones of an earphone according to positioning states of the earphone according to various embodiments.
Figure 16B:
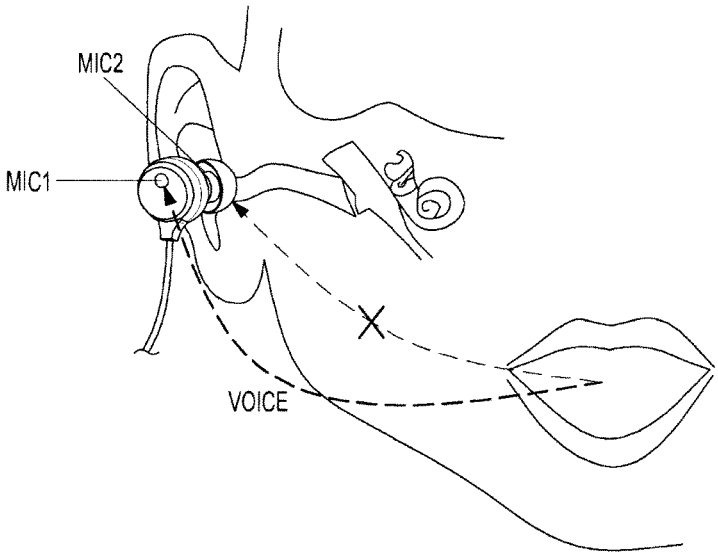

FIGS. 16A and 16B are exemplary views illustrating voice signals input to internal and external microphones of an earphone in correspondence with earphone positioning states according to various embodiments.

Referring to FIG. 16A, in the state where an earphone with earphone units each having two microphones has been removed during a call, the user's voice is input to both microphones MIC1 and MIC2 of each earphone unit. Referring to FIG. 16B, in the state where the earphone has been normally worn, the user's voice may be input to the external microphone directed outward from an ear of the user, while the user's voice may not be input or a less amount of the user's voice may be input to the internal microphone directed inward in the other ear of the user.

For example, in the state where the right earphone unit is removed as illustrated in FIG. 16A, the correlation between signals input to the external microphone MIC1 and internal microphone MIC2 of the right earphone unit may be higher than a threshold. When the user's voice is input to the internal and external microphones MIC2 and MIC1 of the right earphone unit, the distances between the mouth of the speaker and the two microphones MIC1 and MIC2 may be equal or similar because the microphones MIC1 and MIC2 are very close. Therefore, signals of the internal and external microphones MIC1 and MIC2 may be highly correlated in frequency characteristics, level, and delay.

If any of the correlation between signals input to the internal and external microphones of the right earphone unit and the correlation between signals input to the internal and external microphones of the left earphone unit is higher than a threshold, the earphone unit having the correlation higher than the threshold may be in a wrong positioning state. If both of the correlations are higher than the threshold, both of the left and right earphone units have been removed or loosely worn.

As illustrated in FIG. 16B, meanwhile, if the earphone has been normally worn, when the user's voice is input to the internal and external microphones MIC1 and MIC2 of the right earphone unit, the correlation between the signals input to the internal and external microphones MIC1 and MIC2 of the right earphone unit may be low. In the normal positioning state, the speaker's voice may be transferred to the external microphone MIC1 of the right earphone unit through ambient air, whereas the speaker's voice may not be transferred or may be transmitted to the internal microphone MIC2 of the right earphone unit, passing through the ear. Thus, the correlation between the signals input to the two microphones MIC1 and MIC2 may be very low.

As described above, the electronic device 101 may determine the positioning state of the earphone based on the correlation between signals of microphones of each earphone unit.

Figure 17A:
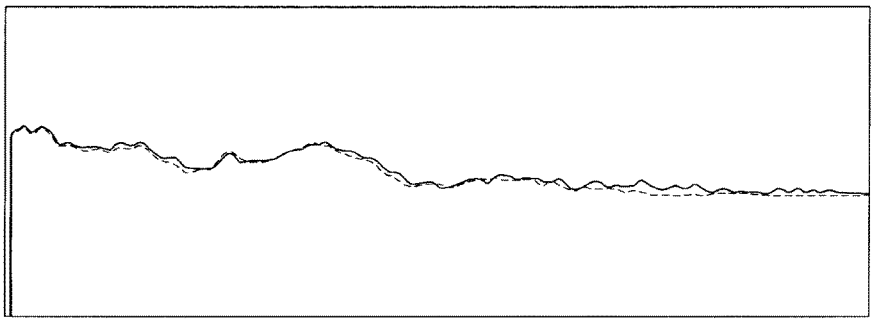
FIG. 17A and FIG. 17B are graphs illustrating frequency characteristics of signals introduced to internal and external microphones of an earphone according to positioning states of the earphone according to various embodiments.
Figure 17B:
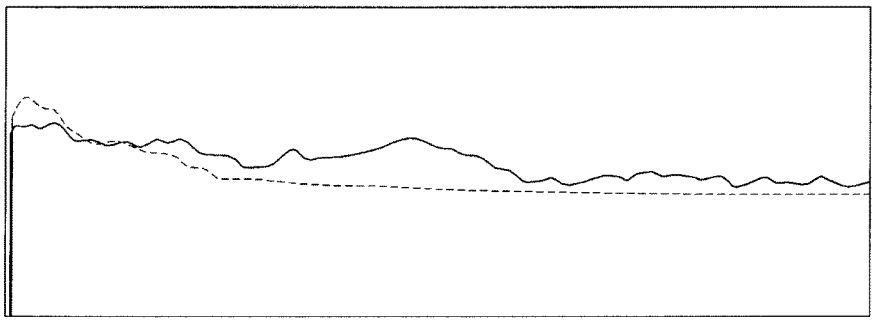

FIGS. 17A and 17B are graphs illustrating frequency characteristics of signals introduced to internal and external microphones of an earphone according to positioning states of the earphone according to various embodiments.

As illustrated in FIG. 17A, if the earphone has been wrongly positioned, signals input to the two microphones MIC1 and MIC2 may be similar (the signal from MIC1 is the solid line, while the signal to MIC2 is the dashed line). As illustrated in FIG. 17B, if the earphone has been normally positioned, signals input to the two microphones MIC1 and MIC2 may be different. For example, a voice signal input to the microphone MIC2 directed inward in an ear does not include a signal in a band of 2 kHz or above, with a low-band signal focused. Therefore, a signal input to the microphone MIC1 directed outward from the ear and a signal input to the microphone MIC2 directed inward in the ear may be different in terms of frequency characteristics, as illustrated in FIG. 17B.

Figure 18A:
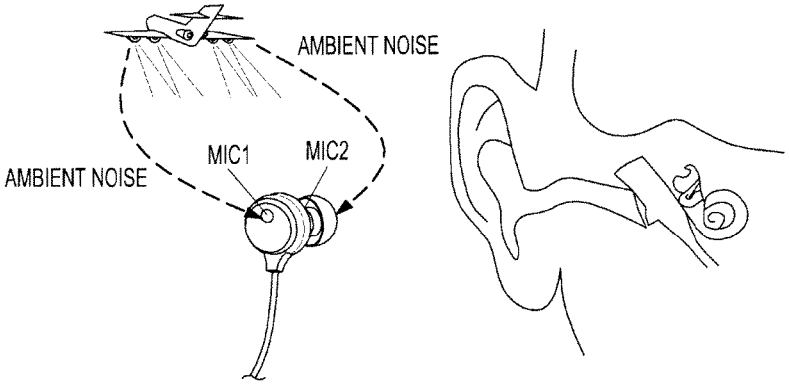
FIG. 18A and FIG. 18B are exemplary views illustrating ambient noise signals introduced to internal and external microphones of an earphone according to positioning states of the earphone according to various embodiments.
Figure 18B:
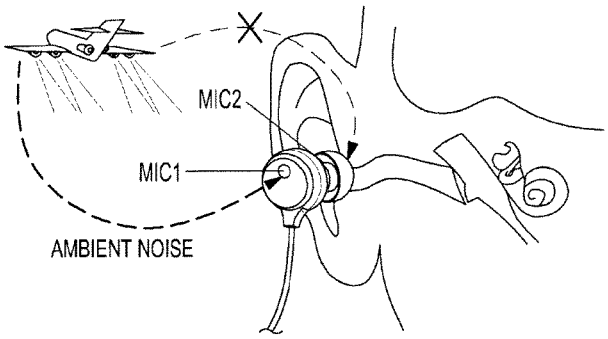

FIGS. 18A and 18B are exemplary views illustrating ambient noise signals introduced to internal and external microphones of an earphone according to positioning states of the earphone according to various embodiments.

As illustrated in FIG. 18A, if an earphone having two microphones has been removed during video or audio recording in an ambient noise environment, ambient noise is introduced into both of the microphones MIC1 and MIC2. On the other hand, as illustrated in FIG. 18B, if the earphone has been worn normally, ambient noise may be introduced into the microphone MIC1 directed outward from the ear, whereas the ambient noise may not be introduced into or may be reduced in the microphone MIC2 directed inward in the ear. Based on the idea that the microphone MIC2 directed inward in the user's ear is shielded by the ear and thus ambient noise is reduced in the microphone MIC2, it may be determined whether the earphone has been wrongly positioned.

Specifically, upon receipt of external sounds through the internal and external microphones of the earphone, the electronic device 101 may analyze noise in the input signals. If the same noise level is estimated in the signals input to the internal and external microphones of the earphone, the electronic device 101 may determine that the earphone has been wrongly positioned (or has been removed), as illustrated in FIG. 18A. However, if the signal of the external microphone MIC1 has a large magnitude relative to the signal of the internal microphone MIC2, the electronic device 101 may determine the normal positioning state of the earphone as illustrated in FIG. 18B.

Accordingly, the electronic device 101 may control a multi-microphone noise cancellation parameter or perform a single-microphone noise cancellation operation in the wrong positioning state of the earphone as illustrated in FIGS. 16A and 18A.

As is apparent from the foregoing description, according to various embodiments of the present disclosure, even though the left and right speakers of an earphone have been worn exchanged in position, audio signals corresponding to the left and right ears of a user may be output by correction. Therefore, degradation of the sound quality of the earphone may be prevented, and the user does not need to change the earphone positioning state manually. As a consequence, user convenience may be increased.

According to various embodiments of the present disclosure, even though the left and right speakers of the earphone have been worn exchanged in position, microphone signals corresponding to the left and right of the user may be input by correction. Therefore, the surrounds may be recorded without distortions, and the user does not need to change the earphone positioning state manually. As a consequence, user convenience may be increased.

According to various embodiments of the present disclosure, in the state where one of the left and right speakers of the earphone has slipped off from an ear, noise is cancelled in a voice signal introduced into a microphone of the earphone, which has been normally worn. Therefore, noise generated from an ambient environment may be effectively reduced and a hearing environment with an enhanced sound quality may be provided to the user.

According to various embodiments of the present disclosure, the electronic device may determine whether the earphone has been wrongly positioned and thus notify the user of the wrong positioning state of the earphone.

The term "module" as used herein may refer hardware, or hardware programmed with instructions. The term "module" may be used interchangeably with terms such as, for example, unit, logic, logical block, component, or circuit. A "module" may be the smallest unit of an integrated part or a portion thereof. A "module" may be the smallest unit for performing one or more functions, or a portion thereof. A "module" may be implemented mechanically, or electronically. For example, a "module" may include at least one of a known, or to-be-developed, application-specific integrated circuit (ASIC) chip, field-programmable gate array (FPGA) or programmable logic device that perform certain operations.

At least a part of devices (for example, modules or their functions) or methods (for example, operations) according to various embodiments of the present disclosure may be implemented as commands stored in a computer-readable storage medium (for example, the memory 130), in the form of a programming module. When the commands are executed by a processor (for example, the processor 120, the processor may execute functions corresponding to the commands. The computer-readable medium may include hard disk, floppy disk, magnetic media (for example, magnetic tape), optical media (for example, compact disc read-only memory (CD-ROM)), digital versatile disc (DVD), magneto-optical media (for example, floptical disk), hardware devices (for example, read-only memory (ROM), random access memory (RAM) or flash memory)), and the like. Program instructions may include machine language code that are produced by a compiler or high-level language code that may be executed by a computer using an interpreter.

A module or a programming module according to various embodiments of the present disclosure may include one or more of the above-described components, may omit a portion thereof, or may include additional components. Operations that are performed by a module, a programming module or other components according to the present disclosure may be processed in a serial, parallel, repetitive or heuristic manner. Also, some operations may be performed in a different order or omitted, or additional operations may be added.

According to various embodiments of the present disclosure, a storage medium may store instructions configured to, when executed by at least one processor, control the at least one processor to perform at least one operation. The at least one operation may include receiving a first audio signal through at least one first microphone positioned in a first body of an earphone connected to an electronic device and a second audio signal through at least one second microphone positioned in a second body of the earphone, and determining a positioning state of the earphone based on a difference between the first and second audio signals.

The embodiments disclosed in the present specification are provided for description and understanding of the present disclosure, not limiting the scope of the present disclosure. Accordingly, the scope of the present disclosure should be interpreted as embracing all modifications or various embodiments within the scope of the present disclosure therein.

What is claimed is:

1. An electronic device comprising:

a speaker positioned on a surface of a housing;

at least one sensor for outputting sensing information used in detecting a direction in which the speaker faces; and at least one processor configured to:

receive a first audio signal received through at least one microphone positioned in a first body of an earphone detachably connectable to the electronic device and a second audio signal received through at least one microphone positioned in a second body of the earphone, calculate a time delay and a level difference between the first audio signal and the second audio signal, and determine a positioning state of the earphone based on the direction in which the speaker faces and at least one of the time delay and the level difference.

2. The electronic device of claim 1, wherein when an audio signal is output from the speaker of the electronic device, the processor acquires the first audio signal corresponding to the audio signal through the at least one microphone on the first body of the microphone and the second audio signal corresponding to the audio signal through the at least one microphone on the second body of the microphone.

3. The electronic device of claim 1, wherein if the time delay is outside a threshold range, the processor is configured to:

determines that the positioning state of the earphone is a removal state, and indicates the removal state of the earphone.

4. The electronic device of claim 1, wherein if each of the time delay and the level difference is less than a threshold, the processor is configured to determine a wrong positioning state of the earphone, in which first and second speakers worn to be positioned inside both ears of a user are exchanged in position.

5. The electronic device of claim 4, wherein if the positioning state of the earphone is the wrong positioning state, the processor is configured to exchanges signals output through the first and second speakers.

6. The electronic device of claim 1, further comprising a microphone on the surface of the housing, wherein the processor is configured to determines the positioning state of the earphone based on a correlation between an audio signal input to the microphone and the first audio signal and a correlation between the audio signal input to the microphone and the second audio signal.

7. The electronic device of claim 1, wherein when voice signals are input to the at least one microphone on the first body and the at least one microphone on the second body, the processor is configured to determine the positioning state of the earphone based on a result of comparing the voice signal input to the at least one microphone on the first body with the voice signal input to the at least one microphone on the second body.

8. The electronic device of claim 1, wherein the at least one microphone on the first body includes a first microphone and a second microphone, and the at least one microphone on the second body includes a third microphone and fourth microphone, and wherein the earphone includes a first speaker disposed at a first position of the first body, the first microphone disposed at a second position of the first body, the second microphone disposed at a third position of the first body, a second speaker disposed at a first position of the second body, the third microphone disposed at a second position of the second body, and the fourth microphone disposed at a third position of the second body, and wherein when the earphone is worn on a user, the first and second speakers are inserted into both ears of the user, the first and third microphones are exposed outward from both of the ears of the user, and the second and fourth microphones are inserted into both of the ears of the user.

9. The electronic device of claim 8, wherein if at least one of a correlation between a signal input to the first microphone and a signal input to the second microphone and a correlation between a signal input to the third microphone and a signal input to the fourth microphone is higher than a threshold, the processor is configured to determines that the positioning state of the earphone is a wrong positioning state.

10. The electronic device of claim 9, wherein the processor is configured to cancel noise in a signal input to remaining microphones except for microphones having a correlation higher than the threshold.

11. A method for detecting wrong positioning of an earphone by an electronic device, the method comprising:

acquiring sensing information about the electronic device, for use in detecting a direction in which a speaker positioned on a first surface of a housing in the electronic device faces;

receiving a first audio signal through a first microphone positioned in a first body of an earphone operatively connected to the electronic device, and a second audio signal through a second microphone positioned in a second body of the earphone;

calculating a time delay and a level difference between the first audio signal and the second audio signal; and determining a positioning state of the earphone based on the direction in which the speaker faces and at least one of the time delay and the level difference.

12. The method of claim 11, wherein the reception of a first audio signal and a second audio signal comprises:

when an audio signal is output from the speaker, acquiring the first audio signal corresponding to the audio signal through the first microphone and the second audio signal corresponding to the audio signal through the second microphone.

13. The method of claim 11, further comprising:

if the time delay is outside a threshold range, determining that the positioning state of the earphone is a removal state; and indicating the removal state of the earphone.

14. The method of claim 11, further comprising:

when each of the time delay and the level difference is less than a threshold, determining a wrong positioning state of the earphone, in which first and second speakers worn to be positioned inside both ears of a user are exchanged in position; and switching signals output through the first and second speakers, and outputting the switched signals.

15. The method of claim 11, wherein the determination of the positioning state of the earphone comprises:

determining the positioning state of the earphone based on a correlation between an audio signal input to a microphone on the surface of the housing and the first audio signal and a correlation between the audio signal input to the microphone and the second audio signal.

16. The method of claim 11, further comprising:

receiving voice signals through the first microphone and the second microphone; and determining the positioning state of the earphone based on a result of comparing the voice signal input to the first microphone with the voice signal input to the second microphone.

17. The method of claim 11, further comprising, when a third microphone is disposed at a position opposite to the first microphone in the first body, and a fourth microphone is disposed at a position opposite to the second microphone in the second body, comparing at least one of a correlation between a signal input to the first microphone and a signal input to the third microphone and a correlation between a signal input to the second microphone and a signal input to the fourth microphone with a threshold;

when the at least one correlation is higher than the threshold, determining that the positioning state of the earphone is a wrong positioning state; and cancelling noise in a signal input to remaining microphones except for microphones having a correlation higher than the threshold.

18. A non-transitory computer-readable storage medium of an electronic device storing instructions configured to, when executed by at least one processor, control the at least one processor to perform at least one operation, the at least one operation comprising:

acquiring sensing information about the electronic device, for use in detecting a direction in which a speaker positioned on a first surface of a housing in the electronic device faces;

receiving a first audio signal through a first microphone positioned in a first body of an earphone operatively connected to an electronic device, and a second audio signal through a second microphone positioned in a second body of the earphone;

calculating a time delay and a level difference between the first audio signal and the second audio signal; and determining a positioning state of the earphone based on the direction in which the speaker faces and at least one of the time delay and the level difference.

* * * * *